US009833883B2

(12) United States Patent
Wang

(10) Patent No.: US 9,833,883 B2
(45) Date of Patent: Dec. 5, 2017

(54) BI-DIRECTIONAL SCREWDRIVER

(71) Applicants: Hangzhou Great Star Tools Co., Ltd., Hangzhou (CN); Hangzhou Great Star Industrial Co., Ltd., Hangzhou (CN)

(72) Inventor: Weiyi Wang, Hangzhou (CN)

(73) Assignees: Hangzhou Great Star Tools Co., Ltd., Hangzhou (CN); Hangzhou Great Star Industrial Co., Ltd., Hangzhou (CN)

( * ) Notice: Subject to any disclaimer, the term of this patent is extended or adjusted under 35 U.S.C. 154(b) by 93 days.

(21) Appl. No.: 14/369,893

(22) PCT Filed: Sep. 9, 2013

(86) PCT No.: PCT/CN2013/083112

§ 371 (c)(1),
(2) Date: Jun. 30, 2014

(87) PCT Pub. No.: WO2014/110905

PCT Pub. Date: Jul. 24, 2014

(65) Prior Publication Data

US 2016/0167205 A1 Jun. 16, 2016

(30) Foreign Application Priority Data

Jan. 18, 2013 (CN) ..... 2013 2 0028403 U
Apr. 3, 2013 (CN) ..... 2013 1 0115659

(51) Int. Cl.
*B25B 17/00* (2006.01)
*B25B 15/04* (2006.01)

(52) U.S. Cl.
CPC ..... *B25B 17/00* (2013.01); *B25B 15/04* (2013.01)

(58) Field of Classification Search
CPC ..... B25B 15/04; B25B 15/02; B25B 17/02
(Continued)

(56) References Cited

U.S. PATENT DOCUMENTS 4,770,071 A * 9/1988 Steier ..... B25B 15/04 81/57.22
4,802,387 A * 2/1989 Williams, III ..... B25B 13/462 475/12

(Continued)

FOREIGN PATENT DOCUMENTS

CN 101890688 A 11/2010
CN 202292572 U 7/2012

(Continued)

*Primary Examiner* — Larry E Waggle, Jr.
*Assistant Examiner* — Henry Hong
(74) *Attorney, Agent, or Firm* — Dinsmore & Shohl LLP

(57) ABSTRACT

The present disclosure is a bi-directional screwdriver, which includes a handle, a main shaft, a gearing which includes a driving gear, a driven gear, a transmission seat and an idle gear which is mounted on the idle gear axle on the transmission seat and is fitted between the driving gear and the driven gear for transferring motion. The handle rotates the driving gear. A grip ring is securely provided outside the idle gear axle. When the grip ring is gripped and the handle is rotated to rotate the driving gear, the driving gear rotates the driven gear in a reverse direction through the idle gear. The driving gear also has a first inside ratchet surface, and the driven gear also has a second inside ratchet surface. And the present invention also includes a reversing means which includes a reversing member, a first pawl member and a second pawl member, and a direction switch, in which the driving gear, the driven gear and the transmission seat are all sleeved on the reversing member, the reversing member is sleeved on the main shaft and able to rotate the main shaft.

13 Claims, 18 Drawing Sheets

(58) Field of Classification Search
USPC ..... 81/57.31, 58.3
See application file for complete search history.

(56) References Cited

U.S. PATENT DOCUMENTS

| | | | | | |
|---|---|---|---|---|---|
| 5,058,463 | A * | 10/1991 | Wannop | B25B 13/467 | 81/57.26 |
| 5,406,866 | A * | 4/1995 | Badiali | B25B 15/02 | 81/57.3 |
| 5,931,062 | A * | 8/1999 | Marcovici | B25B 13/467 | 81/177.2 |
| 6,082,226 | A | 7/2000 | Lin | | |
| 6,205,891 | B1 | 3/2001 | Huang et al. | | |
| 2010/0294084 | A1* | 11/2010 | Gauthier | B25B 15/02 | 81/60 |
| 2014/0116205 | A1* | 5/2014 | Wang | B25B 13/462 | 81/63.1 |
| 2016/0167205 | A1 | 6/2016 | Wang | | |

FOREIGN PATENT DOCUMENTS

| | | | |
|---|---|---|---|
| CN | 202462319 | U | 10/2012 |
| CN | 102788129 | A | 11/2012 |
| CN | 203045591 | U | 7/2013 |
| EP | 2946885 | A1 | 11/2015 |
| WO | WO-9851449 | A1 | 11/1998 |

* cited by examiner

BI-DIRECTIONAL SCREWDRIVER

FIELD OF THE INVENTION

The present invention relates to a hand tool, and more particularly relates to a bi-directional screwdriver.

DESCRIPTION OF THE PRIOR ART

In use of hand tools such as common screwdrivers, there is certain limitation to the motion of the hand in the rotation direction, which cannot be along one direction consecutively. In such tools, the rotation shaft and the main shaft of the handle are coaxial, and usually the following is the case when the tools are in use: firstly, rotating the handle with hand in a desired direction (for example, tightening or loosening a screw), then the hand turns in reverse direction so that the tools can be re-positioned for another cycle. In the second part of the above cycle, the reverse turning of the hand can be that after the hand releasing the handle is gripped again, or also a single direction mechanism such as a ratchet mechanism is arranged in the tool, so that the main shaft remains stationary when the handle is rotated in reverse direction, or the tool is detached from the screw and then inserted into the screw again. However, anyway, the reverse turning of the hand will never bring effective motions of a fastener, therefore is considered as a wasted motion.

U.S. Pat. No. 5,931,062 has disclosed a mechanical rectifier, comprising a shaft and two driving elements mounted on the shaft, each having a one-way clutch interposed between it and the shaft, with the clutches oriented in the same way on the shaft so that the shaft is always entrained in only one direction of rotation when either one of the two driving elements is rotated in that direction, and the shaft is overrun by a driving element that is rotated in the opposite direction; also comprises a reversing mechanism coupling the two driving elements together and forcing them to always rotate in opposite directions so that one driving element entrains the shaft and the other driving element overruns the shaft, thus causing the shaft to always turn in only one direction, regardless of the direction of rotation of the driving elements. Thus, the rotation of the rotation device (such as a handle) in either direction is converted into unidirectional rotation of the shaft. The mechanical rectifier can efficiently utilize the rotation of the rotation device in any directions, that is, no matter if the handle rotates in clockwise direction or in counterclockwise direction, the main shaft always rotates in one direction, thereby the motion efficiency of the handle is greatly improved and the operation time is saved.

However, the reversing mechanism of this invention can only make the main shaft rotate in one direction. In order to adapt to the need of the main shaft rotatable in both directions (such as, tightening or loosening a fastener when implemented as a screwdriver), the handle of this invention have to be removable from the main shaft which is coaxial with the handle, and both ends of the main shaft (set as ends A and B) can be mounted with screwdrivers. Supposing end A of the shaft is used to tighten a fastener in the beginning, if the fastener needs to be loosened, the handle mounted at end B of the shaft has to be dismounted from the main shaft, and the handle is mounted at end A of the shaft and proper screwdriver bit is mounted at end B, and then the motion of loosening the fastener can be proceeded. And if the fastener to be loosened is of the same model as the original fastener being tightened, the screwdriver bit has to be removed from end A and mounted to end B before the handle changes position. Thus it can be seen that the mechanical rectifier of this invention has inconveniences in changing the direction of the main shaft. To multi-function screwdrivers with changeable driver bits, changing driver bits at both ends of the main shaft is even more troublesome. In addition, it must be ensured that the handle can be taken off from the main shaft readily, which means the integrity of the whole screwdriver cannot be guaranteed, and parts can easily be missing.

Further, this kind of mechanical structure has relatively low rotation speed, and it is desirable to provide a direction-changeable screwdriver with higher operational efficiency.

SUMMARY OF THE INVENTION

The object of the present invention is to provide a bi-directional screwdriver, comprising a reversing means with pawls, which is convenient for processing.

Another object of the present invention is to provide a bi-directional screwdriver, which has a speed increasing mechanism allowing a bi-directional screwdriver to rotate in an increased speed.

Another object of the present invention is to provide a bi-directional screwdriver, which, based on the speed increasing mechanism, also has a speed increasing switch allowing a bi-directional screwdriver be selected to use speed increasing or not to use speed increasing.

A bi-directional screw driver, comprising a handle, a main shaft, a gearing which comprises a driving gear, a driven gear, a transmission seat and an idle gear which is mounted on an idle gear axle on the transmission seat and is fitted between the driving gear and the driven gear for transferring motion, wherein the handle rotates the driving gear, and a grip ring is securely disposed outside the idle gear axle, and when the grip ring is rotating relative to the handle, the driving gear is rotated and rotates the driven gear in a reverse direction through the idle gear, wherein the driving gear also has a first inside ratchet surface, and the driven gear also has a second inside ratchet surface; and also comprising a reversing means which includes a reversing member, a first pawl member and a second pawl member, and a reversing switch, wherein the driving gear, the driven gear and the transmission seat are all sleeved on the reversing member, the reversing member is sleeved on and main shaft, being able to rotate the main shaft; wherein the first pawl member has a first pawl and a second pawl selectively engaging with the first ratchet surface, wherein the first pawl slides over the first ratchet surface in a first direction, and engages with the first ratchet surface for transmission in a second direction, the second pawl engages with the first ratchet surface for transmission in the first direction, and slides over the first ratchet surface in the second direction; the second pawl member has a third pawl and a fourth pawl selectively engaging with the second ratchet surface, wherein the third pawl slides over the first ratchet surface in the first direction, and engages with the first ratchet surface for transmission in the second direction, the fourth pawl engages with the first ratchet surface for transmission in the first direction, and slides over the first ratchet surface in the second direction; the reversing switch can set the first pawl member and the second pawl member in a first state and a second state, in the first state, the first pawl and the third pawl respectively engage with the first ratchet surface and the second ratchet surface at the same time; in the second state, the second pawl and the fourth pawl respectively engage with the first ratchet surface and the second ratchet surface at the same time; the first direction is a clockwise or counterclockwise direction, the second direction is a reverse direction of the first direction.

Further, the first pawl member and/or the second pawl member are fan-shaped, wherein the first pawl and the second pawl, the third pawl and the fourth pawl are fan-shaped toothed surfaces.

Further, the reversing switch comprises a central shaft, a first ball plug and a second ball plug, the central shaft is provided through inside the reversing member, the first ball plug and the second ball plug are secured to the central shaft successively, the first ball plug and the second ball plug engage with recesses on the fan-shaped bottom surfaces of the first pawl member and the second pawl member respectively.

Further, an elastic member is fitted between the first and the second ball plug and the central shaft.

Further, the first pawl member and the second pawl member are mounted on a secondary shaft which is parallel to the reversing member.

Further, the front end of the central shaft is provided with a helical sliding slot, the bi-directional screwdriver also comprises a head cover sleeved on the front end of the reversing member, a guide way parallel to the axis of the main shaft is provided on the head cover, a push button assembly is provided in the guide way and is slidable along the guide way and the sliding slot for controlling the position of the central shaft so as to set a rotation direction of the main shaft.

The bi-directional screwdriver of the present invention also comprises a speed increasing mechanism comprising a gear shaft arranged at the tail part of the driving gear and a speed increasing planetary gear mechanism which comprises a gear ring securely connected to the grip ring, three planetary gear engaging between the gear shaft and the gear ring, and a planetary carrier sleeve connected to the handle; when the gear ring is rotating relative to the handle, the planetary carrier sleeve rotates the planetary gear which rotates the gear shaft in increased speed, the gear shaft inputs the speeded-up rotation to the driving gear.

Further, the gear shaft has thereon a first gear surface engaging with the planetary gear, a smooth surface and a second gear surface, an internal gear is provide on the inner circumferential surface of the planetary carrier sleeve arranged able to slide between an engaging position and a disengaged position on the gear shaft, the planetary carrier sleeve engages with the planetary gear when the planetary carrier sleeve slides to the engaging position, the internal gear is located on the smooth surface of the gear shaft at the moment; the planetary carrier sleeve is disengaged from the planetary gear when the planetary carrier sleeve slides to the disengaged position, the internal gear is located at the second gear surface and engages therewith.

The bi-directional screwdriver of the present invention also comprises a speed increasing switch for driving the planetary carrier sleeve to slide between the engaging position and the disengaged position.

Further, an outer sleeve is also provided outside the planetary carrier sleeve, the handle is sleeved on the outside of the outer sleeve.

A further description will be made as to the conception, detailed structure, and expected technical effects of the present invention with reference to the accompanying drawings to make the objects, features, and advantages of the present invention fully understandable.

DETAILED DESCRIPTION OF THE PREFERRED EMBODIMENTS

Embodiment One

Figure 1:
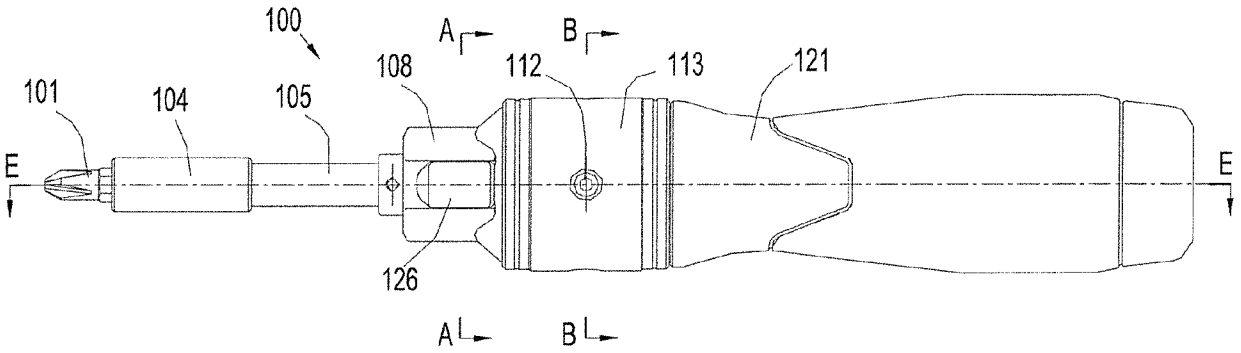
FIG. 1 is a main view of the first embodiment of the present invention in the first operating state.
Figure 2:
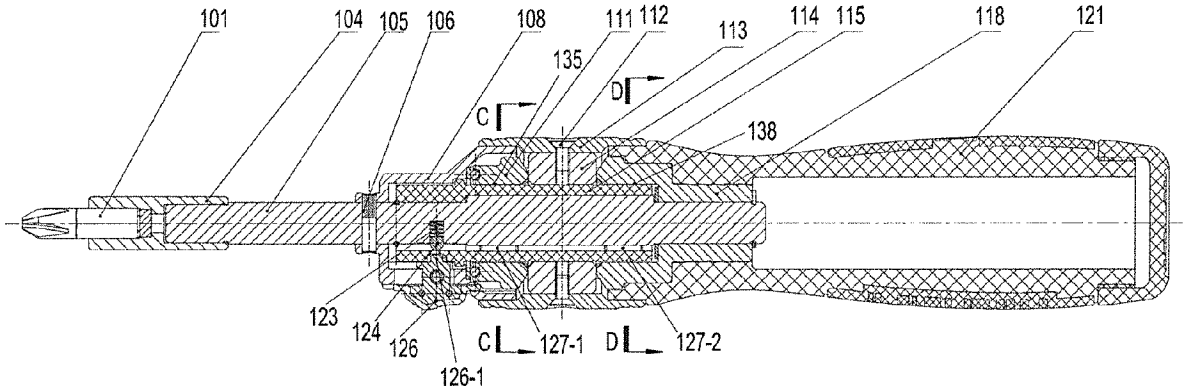
FIG. 2 is a sectional view of the embodiment shown in Figure, taken along line E-E.
Figure 4:
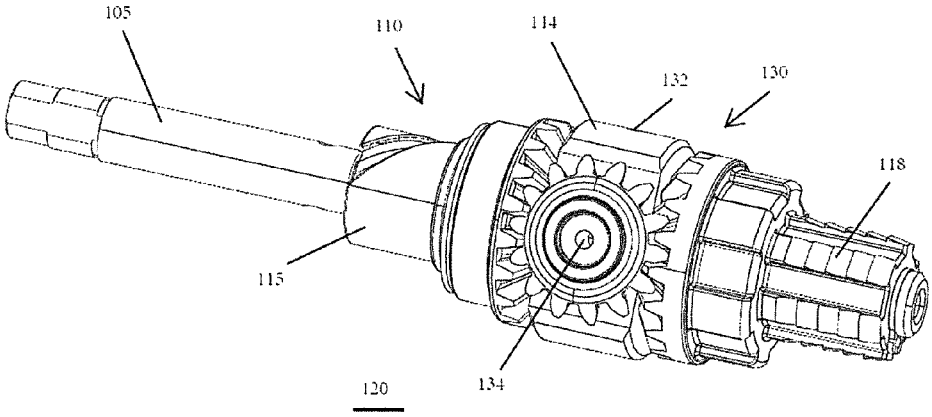
FIG. 4 is a schematic view of the transmission mechanism of the first embodiment of the present invention.
Figure 5:
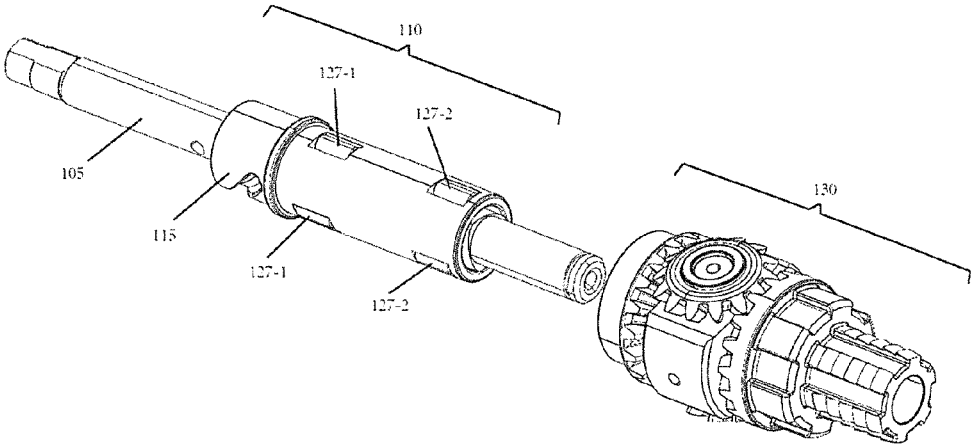
FIG. 5 is an exploded schematic view of the transmission mechanism shown in FIG. 4, in which the gearing is detached from the reversing means.
Figure 6:
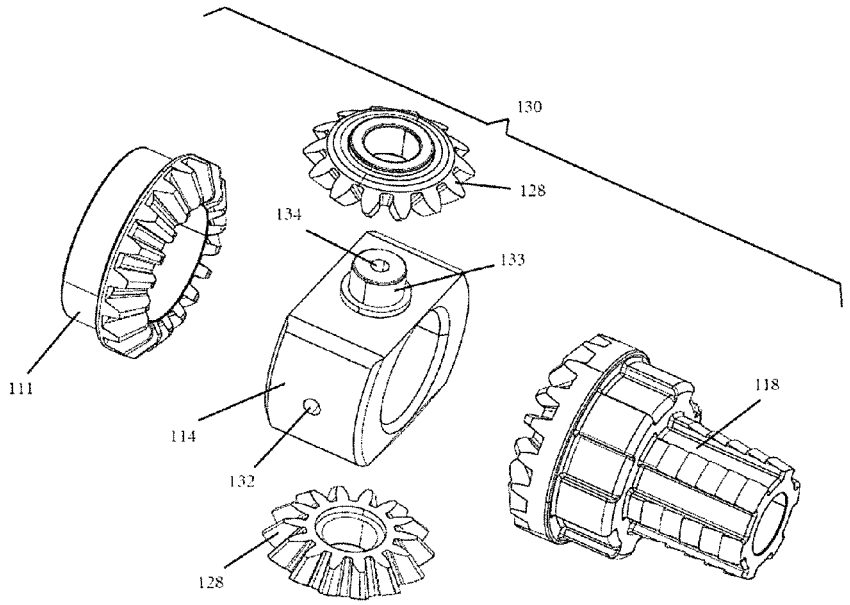
FIG. 6 is an exploded schematic view of the gearing shown in FIG. 5.

Referring to FIG. 1 and FIG. 2, in a preferred embodiment, the bi-directional mechanical converter is applied in a manually actuated screwdriver 100, and bi-directional multiple speed of transmission is achieved in the screwdriver 100 through a transmission mechanism 120 shown in FIG. 4. The transmission mechanism 120 includes a gearing 130 and a reversing means 110 shown in FIG. 4, being able to realize the switching of the rotation direction of the main shaft. FIG. 5 and FIG. 6 show the structural and mounting relationship between the gearing 130 and the reversing means 110. The 'bi-directional multiple speed transmission' or 'bi-directional transmission' are referred to in relation to the input, that is, the handle serves as a rotation mechanism, the input force of which can be in any direction of clockwise direction or counterclockwise direction and can be efficiently utilized, whereas the feature 'direction-changeable' of the present invention refers to that the output rotation direction of the main shaft can selectively be clockwise or counterclockwise as desired. The clockwise or counterclockwise direction that is referred to in the present description is defined as a rotation direction that is observed in the direction of from the driver bit to the handle along the shaft.

A full description of the structure, operation and principle of operation of the manually actuated screwdriver 100 in this embodiment is set forth as follows:

1 Overall Structure of Screwdriver 100

The screwdriver 100 includes a main shaft 105, a transmission mechanism 120 and a rotation device. In this embodiment, the rotation device is a handle 121, in which the torque inputted from the handle 121 in either directions (either of clockwise or counterclockwise) is transferred to the main shaft 105, causing the main shaft 105 to output torque in a predetermined direction (one of clockwise and counterclockwise). The transmission mechanism 120 is mounted on the main shaft 105 for transferring the driving torque of the handle 121 to the mains shaft 105. By means of the driver bit mounted on the main shaft 105, screwdriver bits 101 of various models can be mounted for outputting torque.

When observed from the outside, the screwdriver 100 also includes a head cover 108 and a grip ring 113.

The head cover 108 is securely coupled to the main shaft 105 through a pin 106, so that the head cover 108 and the main shaft 105 rotate together.

The grip ring 113 and the handle 121 are provided for being gripped by two hands of an operator respectively, in which, the grip ring 113 is stationary when being gripped, and the handle 121 can rotate relative to the grip ring 113 in either directions (either of clockwise or counterclockwise). The stationary grip ring 113 is the basis of the rotation of each of the components in the screwdriver 100.

2 Transmission Mechanism 120

As shown in FIG. 4 and FIG. 5, the transmission mechanism 120 includes a gearing 130 and a reversing means 110 for realizing a direction-changeable bi-directional multiple speed transmission, in which the gearing 130 is sleeved on the outside of the reversing means 110 and the reversing means 110 is sleeved on the outside of the main shaft 105. The reversing means 110 serves in two features: i) engaging with the gearing 130 to realize converting bi-directional input to single directional output (i.e. one-way clutch function), and, ii) switching the output direction (i.e. direction switching function).

2.1 Structure of Transmission Mechanism 130

As shown in FIG. 6, the transmission mechanism 130 includes four bevel gears and a transmission seat 114. The four bevel gears include a driving gear 118, a driven gear 111 and two idle gears 128 coupling the driving gear and the driven gear, in which the use of two idle gears allows a more balanced transmission, and the use of one idle gear is also feasible, which does not compromise the function of the present invention and is not limited thereby. The driving gear 118 and the handle 121 are coupled securely for transferring torque from the handle.

The driving gear 118, transmission seat 114 and driven gear 111 are coaxially sleeved on the reversing member 115 of the reversing means 110 successively in clearance engagement, in which the reversing means 110 leads the driving gear and the driven gear to form a one-way clutch relationship, respectively, with the main shaft 105, that is, in one direction, the driving gear rotates the main shaft and the other driven gear rotates idly; in the other direction, the driving gear and the driven gear are functionally interchanged, with the driven gear which was previously rotating idly causing the main shaft to rotate, and the driving gear now rotating idly relative to the main shaft. The detailed embodiment of the one-way clutch relationship will be described in the following chapter 2.2 and 2.3.

Figure 8A:
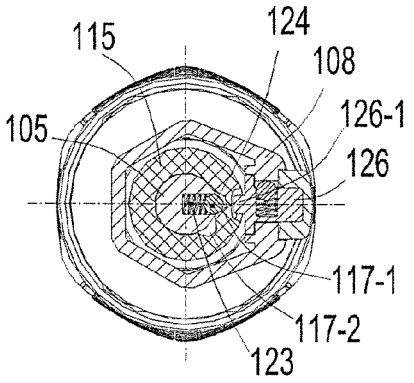
FIG. 8A is a sectional view taken along line A-A in FIG. 1.
Figure 8B:
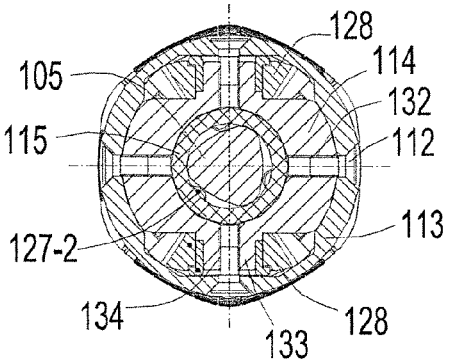
FIG. 8B is a sectional view taken along line B-B in FIG. 1.

FIG. 8B shows the connection relationships between the transmission seat 114, the reversing member 115 and the grip ring 113. The transmission seat is rotatable relative to the reversing member 115. The transmission seat 114 is provided with two idle gear shafts 133 in radial direction for mounting the idle gears 128. The idle gears 128 cause the driving gear 118 and the driven 111 to always be kept to rotate in opposite directions, that is, when the driving gear is rotating in clockwise direction, the driven gear is rotating in counterclockwise direction; on the contrary, when the driving gear is rotating in counterclockwise direction, the driven gear is rotating in clockwise direction.

The transmission seat 114 also includes threaded radial holes 132 used for securing the grip ring 113 which is securely coupled to the transmission seat 114 through screws 112. In this embodiment, threaded holes 134 are also provided on the idle gear shaft 133 in the axial direction. For the structure to be compact, the threaded holes 134 can also be used for securing the grip ring 113, meanwhile the grip ring 113 also functions to limit the axial displacement of the idle gears 128. Naturally, the grip ring 113 of the present invention can also be securely coupled to the transmission seat 114 only through the threaded holes 132, and at the same time an axial stopping block may be provided through the threaded holes 134, or blocking members such as blocking rings be provided on the idle gear shaft 133, for limiting the axial displacement of the idle gears 128.

2.2 The Structure and Principle of the Switching Mechanism 110

As shown in FIG. 5, the reversing means 110 is sleeved on the main shaft 105, and a transmission mechanism 130 is sleeved on the outside the reversing means. The reversing means 110 includes a reversing member 115 and two sets of roller pins 127-1 and 127-2. The reversing member 115 is coaxially sleeved on the main shaft 105 in clearance engagement. Two sets of slots of dimension larger than the roller pins 127-1 and 127-2 are machined on the reversing member 115 for mounting the roller pins 127-1 and 127-2 and allowing the roller pins 127-1 and 127-2 to roll freely. The axes of the roller pins 127-1 and 127-2 are parallel to the axis of the main shaft 105. Referring to FIG. 2, two sets of slots and roller pins 127-1 and 127-2 are positionally corresponding to the driving gear 118 and the driven gear 111 of the transmission mechanism 130 respectively, that is, the first set of slots and roller pins 127-2 engage with the inner circumferential surface 138 of the driving gear 118, and the second set of slots and roller pins 127-1 engage with the inner circumferential surface 135 of the driven gear 111. The inner circumferential surfaces 135 and 138 in this embodiment are circular cylindrical surface.

Figure 7:
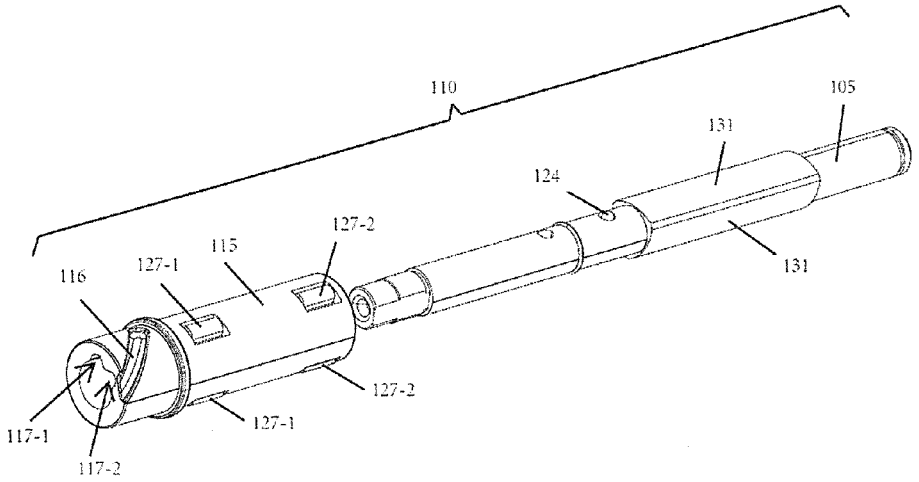
FIG. 7 is an exploded schematic view of the reversing means shown in FIG. 5.
Figure 10:
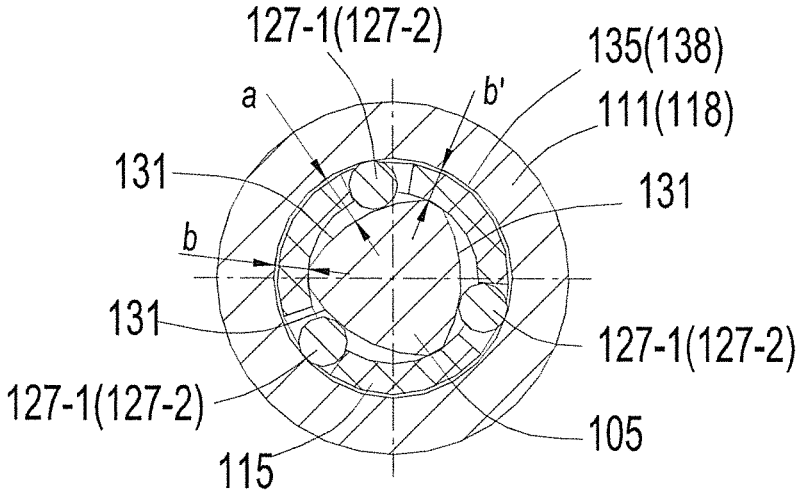
FIG. 10 is a partial schematic view of the engagement relationship between the main shaft and the driving gear or the driven gear in the first embodiment of the present invention.

As shown in FIG. 7 and FIG. 10, shaped surfaces 131 are provided on the main shaft 105 at positions corresponding to the slots and roller pins. In this embodiment, three shaped surfaces 131 are provided on the main shaft 105, corresponding to three roller pins 127-1 or 127-2 in each set, and the roller pins 127-1 and 127-2 can roll on the shaped surfaces 131. In practice, each shaped surface 131 has two sections of operating surface which engage with the inner circumferential surface 135 and the inner circumferential surface 138, respectively, through the roller pins 127-1 and 127-2. The operating surface of the shaped surfaces 131 can be circular cylindrical surface, elliptic cylindrical surface, parabolic surface or other curved surfaces, or plane surface, that is to say, the profile line of the transverse section of the shaped surfaces can be circular arc, elliptic arc, parabolic arc or other arcs, or direction line. A radial clearance is formed between the shaped surface 131 and the inner circumferential surface 138 or the inner circumferential surface 135 (referring to FIG. 10, where the engagement relationship between the main shaft 105 and the driving gear 118 or the driven gear 111 is shown), limiting the range of motion of the roller pins within it. As long as the dimension of the middle portion a of the radial clearance is larger than the diameter of the roller pins 127-1, 127-2 along the circumferential direction of the main shaft, and the dimensions of two end portions b, b' are smaller than the diameter of the roller pins 127-1, 127-2 respectively, the roller pins can move between the two ends of the radial clearance when pushed by the reversing member 115, and, at the engagement place of the roller pins with the shaped surface and the inner circumferential surface, self-lock condition is met, so that the object of the present invention can be achieved. The radial clearance does not have to be symmetrical, that is, b and b' being not equal does not affect the object of the present invention.

In other embodiments, the number of the shaped surfaces can be one, two or more than three, all being able to achieve the object of the present invention, which is not limited by the present invention. Correspondingly, the number of the roller pins in each set can be one, two or more than three, or the number of the roller pins can even be smaller than or larger than the number of the shaped surfaces. For example, the reversing member 115 in this embodiment is provided with six slots in two sets thereon, for mounting the roller pins 127-1 and 127-2. Even if some of the slots are not provided with roller pins therein, but as long as there is at least one roller pin in each set of slot, the object of the present invention can be achieved.

Above all, as long as the driving gear and the driven gear of the transmission mechanism 130 engage with the shaped surface through the roller pins respectively, the object of the present invention can be achieved and the present invention does not limit them. The roller pins of the present invention may also be replaced with other rolling members, such as roller balls, conical rollers, etc., and meanwhile, the shape of the corresponding shaped surface and the inner circumferential surface match with the shape of the rolling member, such as the shaped surface and the inner circumferential surface being arranged to be a loop surface or conical surface. Naturally, each shaped surface 131 can also be machined into two sections of operating surfaces, corresponding to two sets of roller pins 127-1 and 127-2 respectively, so as to achieve the object of the present invention as well. The diameters of the inner circumferential surface 135 and the inner circumferential surface 138 in this embodiment are the same, and if they are different, as long as roller pins of suitable diameters are selected to engage with the corresponding shaped surfaces, the object of the present invention can also be achieved.

The operating principles of the reversing means 110 serving as a one-way clutch and a direction switch in the two operating states are respectively illustrated with reference to the accompanying drawings of FIG. 8A, 8C, 8D and FIG. 9A, 9B, 9C. The reversing means 110 in the Figures is simplified into a structure with a roller pin engaging with a shaped surface of one of the planes of the main shaft 105.

Figure 8C:
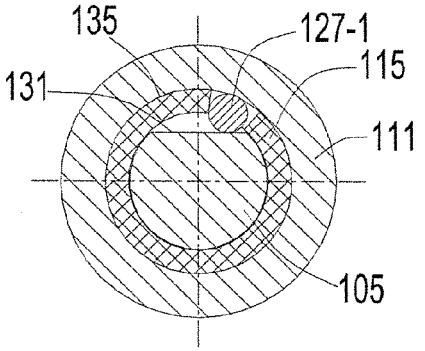
FIG. 8C is a partial schematic view of simplified components shown in FIG. 2, at a cross-section taken along line C-C.
Figure 8D:
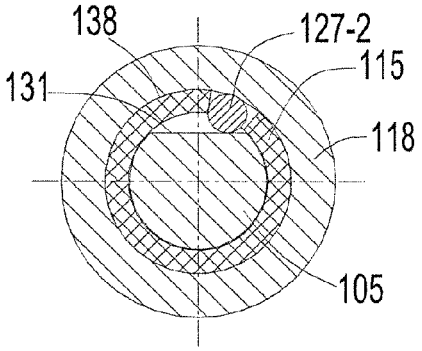
FIG. 8D is a partial schematic view of simplified components shown in FIG. 2, at a cross-section taken along line D-D.

FIG. 8C, 8D are corresponding to the first operating state of this embodiment, in which the roller pins 127-1 and 127-2 are pushed toward the right side in the figures by the reversing element 115. In FIG. 8C, the roller pin 127-1 comes into contact with the inner circumferential surface 135 of the driven gear 111 and the shaped surface 131 simultaneously, and in FIG. 8D, the roller pin 127-2 comes into contact with the inner circumferential surface 138 of the driving gear 118 and the shaped surface 131 simultaneously.

When the driving gear 118 is rotating in clockwise direction, the inner circumferential surface 138 entrains the roller pin 127-2 to rotate in clockwise direction, and the roller pin 127-2 is subject to a rightward friction on the shaped surface 131, that is, both of the forces applied to the roller pin 127-2 by the inner circumferential surface 138 and the shaped surface 131 are rightward, such that the roller pin 127-2 is clamped by the wedge angle formed between the shaped surface 131 and the inner circumferential surface 138, rotating the main shaft 105 in clockwise direction. At this point, the driven gear 111 is rotating in counterclockwise direction, and the roller pin 127-1 engaging with the inner circumferential surface 135 is also rotating in counterclockwise direction, which is subject to a leftward friction on the shaped surface 131, that is, both of the forces applied to the roller pin 127-1 by the inner circumferential surface 135 and the shaped surface 131 are leftward; because of the dimension of the left side radial clearance of the roller pin being greater than the diameter of the roller pin, the roller pin 127-1 is caused to be in loose state, and, correspondingly, the driven gear 111 rotates idly in relation to the main shaft 105.

When the driving gear 118 is rotating in counterclockwise direction, the inner circumferential surface 138 rotates the corresponding roller pin 127-2 in counterclockwise direction, and the roller pin is subject to a leftward friction on the shaped surface 131, that is, both of the forces applied to the roller pin 127-2 by the inner circumferential surface 138 and the shaped surface 131 are leftward; because of the dimension of the left side radial clearance of the roller pin 127-2 being greater than the diameter of the roller pin, the roller pin 127-2 is caused to be in loose state, therefore, the driven gear 111 is rotating idly in relation to the main shaft 105 at this point. However, because of the existence of the idle gear 128, the driven gear 111 is caused to be rotating in clockwise direction. the inner circumferential surface 135 rotates the corresponding roller pin 127-1 in clockwise direction, and the roller pin 127-1 is subject to a rightward friction on the shaped surface 131, that is, both of the forces applied to the roller pin 127-1 by the inner circumferential surface 135 and the shaped surface 131 are rightward, such that the roller pin 127-1 is clamped by the wedge angle formed between the shaped surface 131 and the inner circumferential surface 135, rotating the main shaft 105 in clockwise direction.

Accordingly, no matter if the handle rotates the driving gear in clockwise direction or counterclockwise direction, the main shaft 105 rotates in clockwise direction in the first operating state.

Figure 9A:
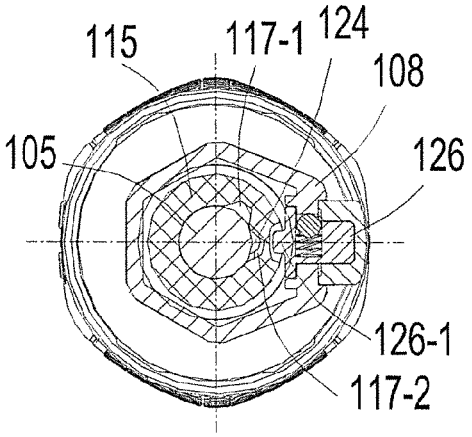
FIG. 9A a sectional view taken along line A'-A' in FIG. 3.
Figure 9B:
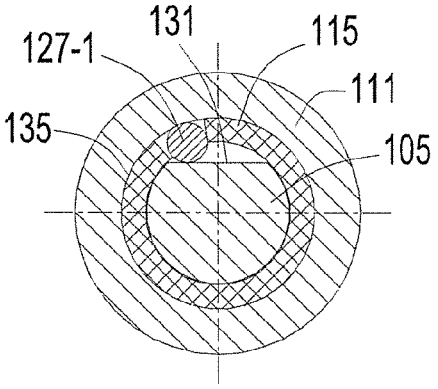
FIG. 9B is a partial schematic view of simplified components shown in FIG. 3, at a cross-section taken along line C-C.
Figure 9C:
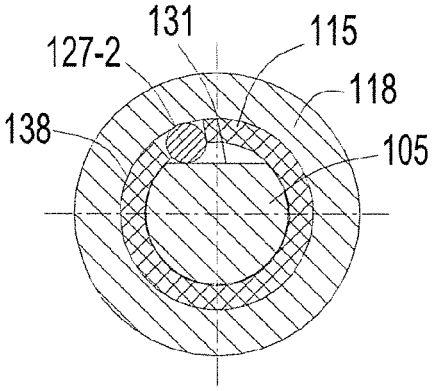
FIG. 9C is a partial schematic view of simplified components shown in FIG. 3, at a cross-section taken along line D-D.

FIG. 9B, 9C corresponds to the second operating state of this embodiment, in which the roller 127-1 and 127-2 are pushed toward the left side in the figures by the reversing member. In FIG. 9B, the roller pin 127-1 comes into contact with the inner circumferential surface 135 of the driven gear 111 and the shaped surface 131 simultaneously, and in FIG. 9C, the roller 127-2 comes into contact with the inner circumferential surface 138 of the driving gear 118 and the shaped surface 131 simultaneously.

When the driving gear 118 is rotating in clockwise direction, the inner circumferential surface 138 rotates the corresponding roller pin 127-2 in clockwise direction, and the roller pin is subject to a rightward friction on the shaped surface 131, that is, both of the forces applied to the roller pin 127-2 by the inner circumferential surface 138 and the shaped surface 131 are rightward; because of the dimension of the right side radial clearance of the roller pin 127-2 being greater than the diameter of the roller pin, the roller pin 127-2 is caused to be in loose state, therefore, the driving gear 118 is rotating idly in relation to the main shaft 105 at this point. However, because of the existence of the idle gear 128, the driven gear 111 is caused to be rotating in counterclockwise direction. The inner circumferential surface 135 rotates the corresponding roller pin 127-1 in counterclockwise direction, and the roller pin 127-1 is subject to a leftward friction on the shaped surface 131, that is, both of the forces applied to the roller pin 127-1 by the inner circumferential surface 135 and the shaped surface 131 are leftward, such that the roller pin 127-1 is clamped by the wedge angle formed between the shaped surface 131 and the inner circumferential surface 135, rotating the main shaft 105 in counterclockwise direction.

When the driving gear 118 is rotating in counterclockwise direction, the inner circumferential surface 138 rotates in counterclockwise direction, and the roller pin 127-2 is subject to a leftward friction on the shaped surface 131, that is, both of the forces applied to the roller pin 127-2 by the inner circumferential surface 138 and the shaped surface 131 are leftward, such that the roller pin 127-2 is clamped by the wedge angle formed between the shaped surface 131 and the inner circumferential surface 138, rotating the main shaft 105 in counterclockwise direction. At this point, the driven gear 111 is rotating in clockwise direction, and the roller pin 127-1 engaging with the inner circumferential surface 135 is also rotating in clockwise direction, which is subject to a rightward friction on the shaped surface 131, that is, both of the forces applied to the roller pin 127-1 by the inner circumferential surface 135 and the shaped surface 131 are rightward; because of the dimension of the right side radial clearance of the roller pin being greater than the diameter of the roller pin, the roller pin 127-1 is caused to be in loose state, and, correspondingly, the driven gear 111 rotates idly in relation to the main shaft 105.

Accordingly, no matter if the handle rotates the driving gear in clockwise direction or counterclockwise direction, the main shaft 105 rotates in counterclockwise direction in the second operating state.

Above all, the reversing means 110 achieves the one-way clutch function in two operating states respectively.

Referring to FIG. 7, FIG. 8A and FIG. 9A, the reversing member 115 is arranged with two positioning slot 117-1 and 117-2 thereon, which engage with the positioning steel ball 124 arranged on the main shaft 105 so as to achieve the aforementioned switching between two operating states. The positioning steel ball 124 is pushed into the positioning slot by a spring 123 located inside the main shaft 105, setting the reversing means 110 into one of the two operating states. By rotating the reversing member 115 through an angle relative to the main shaft 105, the position of the steel ball 124 can be switched between the two positioning slots, allowing this embodiment switches between the aforementioned first operating state and second operating state, so as to achieve the direction switch function of the reversing means 110.

2.3 the Operating Method of the Embodiment is Described with Reference to the Accompanying Figures as Follows 2.3.1 First, the reversing member 115 is rotated relative to the main shaft 105, and the positioning steel ball 124 is disposed in the desired one of the two positioning slots, as in the positioning slot 117-1 as shown in FIG. 8A, then the main shaft 105 is arranged to be able to rotate only in clockwise direction, and the embodiment is in the aforementioned first operating state.

2.3.1.1 The operator holds the grip ring 113 with one hand, and the other hand rotates the handle 121 in clockwise direction to rotate the driving gear 118 to rotate in clockwise direction. At this point, the inner circumferential surface 138 of the driving gear 118 and the shaped surface 131 of the main shaft 105 clamp the corresponding roller pin 127-2, rotating the main shaft 105 in clockwise direction. The idle gear 128 rotates the driven gear 111 in counterclockwise direction, and the roller pin 127-1 corresponding to the driven gear 111 is in loose state, being able to roll, causing the driven gear 111 to rotate idly on the main shaft 105. Therefore, the driven gear does not function at this point.

2.3.1.2 The operator rotates the handle 121 in counterclockwise direction to rotate the driving gear 118 to rotate in counterclockwise direction. At this point, the roller pin 127-2 corresponding to the driving gear 118 is in loose state, being able to roll, causing the driving gear 118 to rotate idly on the main shaft 105. The idle gear 128 rotates the driven gear 111 in clockwise direction, and the roller pin 127-1 corresponding to the driven gear 111 is clamped, and the main shaft 105 is rotated in clockwise direction.

Above all, it is achieved that the main shaft rotates in clockwise direction, no matter in which direction the handle 121 rotates.

2.3.2 Then, the reversing member 115 is rotated relative to the main shaft 105, and the positioning steel ball 124 is changed to be in the positioning slot 117-2, then the main shaft 105 is arranged to be able to rotate only in counterclockwise direction, and the embodiment is in the second operating state. The operator holds the grip ring 113 with one hand, and the main shaft rotates in counterclockwise direction no matter if the other hand rotates the handle in clockwise direction or counterclockwise direction.

3. The Reversing Means 110 is Further Improved in its Structure.

Figure 3:
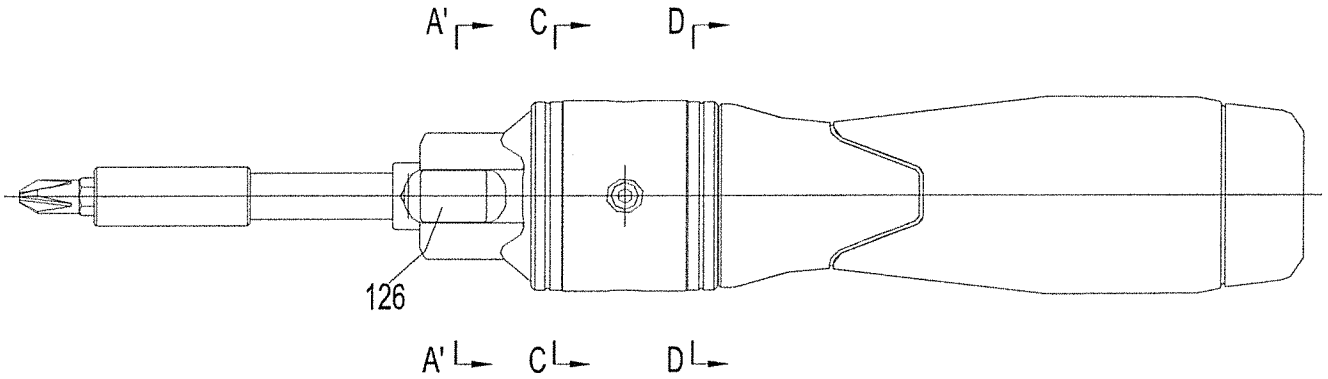
FIG. 3 is a main view of the first embodiment of the present invention in the second operating state.

Referring to FIG. 1, 2, 3, the head cover 108 is also arranged with a sliding slot which is parallel to the axis of the main shaft 105, and which is provided with a push button assembly 126 slidable along the sliding slot, for controlling the position of the reversing member 115, so as to set the rotation direction of the main shaft 105. For example, when the push button assembly 126 is toggled to the front side position (i.e. in the direction toward the driver bit, shown in FIG. 1), the positioning slot 117-1 of the reversing member 115 engages with the positioning steel ball 124, the main shaft 105 is rotatable only in clockwise direction, and the screwdriver 100 is used for tightening a screw. When the push button assembly 126 is toggled to the rear side position (i.e. in the direction away from the driver bit, shown in FIG. 3), the positioning slot 117-2 of the reversing member 115 engages with the positioning steel ball 124, the main shaft 105 is rotatable only in counterclockwise direction, and the screwdriver 100 is used for loosening a screw. Surely, the relationship between the push button and the rotation direction of the main shaft can be reversed, which is not limited by the present invention.

The control of the reversing member 115 by the push button assembly 126 is achieved through a spatial cam mechanism. As shown in FIG. 7 and FIG. 8A, FIG. 9A, a helical sliding slot 116 is arranged on the outer circumferential surface of the reversing member 115. The push button assembly 126 has a portion extending into the sliding slot 116, such as an arm 126-1 or a steel ball, so as to constitute a cam mechanism that converts the axial lineal movement of the push button assembly 126 to the circular movement of the reversing member 115, that is, by toggling the push button assembly 126 along the axis, the arm 126-1 protruding in the sliding slot 116 causes the reversing element 115 to move circularly. Through the cam mechanism, the switching of the push button assembly 126 between the front and rear positions is converted to the switching of the positioning steel ball 124 in the two positioning slots.

To achieve the direction switching without a push button assembly 126, the operator has to hold the main shaft and the reversing member 115 (or the components that are easy to hold, and are respectively securely connected with the above two components) with two hands respectively, and rotate them oppositely. But with the push button assembly 126 disposed, the operator can push it only with one finger to achieve the direction switching. This improvement greatly facilitates the use of the reversing means 110.

In addition, when the method of using the push button assembly 126 to control the rotation of the reversing member 115 is adopted, the structure of the positioning steel ball 124 and two positioning slots can be cancelled. As long as the reversing member 116 can be pushed through the push button assembly 126, and consequently the roller pin is pushed to reach the operation position of the one-way clutch, the object of the present invention can be achieved.

The embodiment also includes structures limiting the unnecessary axial displacement of each component, such as a step, a stop ring, a fastener, etc., and various bearings, shaft sleeve with oil, etc. that are arranged for smooth rotation, which are not detailed described here, and are not limited by the present invention.

In general operations, the grip ring 113 of the embodiment is stationary when being held, that is, compared with an ordinary screwdriver without bi-directional multispeed transmission, the efficiency is doubled. But in actual operations, the grip ring 113 can also be caused to rotate in reverse direction relative to the handle 121, and then the rotation speed of the main shaft 105 is double of that of the handle 121, i.e. the efficiency is quadruple, compared with an ordinary screwdriver without bi-directional multispeed transmission.

Embodiment Two

Figure 11A:
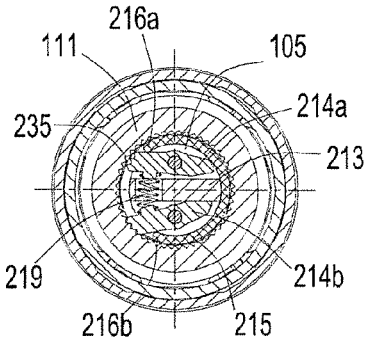
FIG. 11A is a sectional view of a reversing means corresponding to the driven gear in the first operating state of the second embodiment of the present invention, the section position referred to as positions at C-C in FIGS. 2, 3.
Figure 11B:
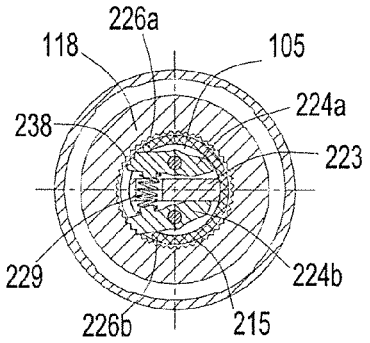
FIG. 11B is a sectional view of a reversing means corresponding to the driving gear in the first operating state of the second embodiment of the present invention, the section position referred to as positions at D-D in FIGS. 2, 3.
Figure 12A:
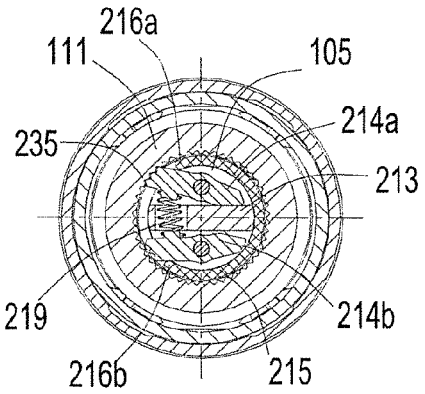
FIG. 12 A is a sectional view of a reversing means corresponding to the driven gear in the second operating state of the second embodiment of the present invention, the section position referred to as positions at C-C in FIGS. 2, 3.
FIG. 12B is a sectional view of a reversing means corresponding to the driving gear in the second operating state of the second embodiment of the present invention, the section position referred to as positions at D-D in FIGS. 2, 3.

The embodiment is similar to Embodiment One, the only difference is that the reversing means 110 in Embodiment One is replaced with the ratchet-pawl reversing means as shown in FIG. 11A, 11B and FIG. 12A, 12B. Pawl seats are arranged on the main shaft 105. Two opposed rotatable pawls are arranged symmetrically on the pawl seat, i.e. the pawl seat 223 and pawls 224*a* and 224*b* corresponding to the driving gear 118 in FIGS. 11B and 12B, and the pawl seat 213 and pawls 214*a* and 214*b* corresponding to the driven gear 111 in FIGS. 11A and 12A. An opening is provided on the reversing member 215. Both ends of the opening are capable of pushing the pawls to change the operating position of the pawls (i.e. to set the rotation direction of the main shaft). In FIGS. 11A and 12A, the two ends of the opening of the reversing member 215 are 216*a* and 216*b*, and the two ends are 226*a* and 226*b* in FIGS. 11B and 12B. The inner circumferential surfaces of the driving gear 118 and the driven gear 111 are changed to be inside ratchet surfaces 238 and 235 having circular distribution. These two inside ratchet surfaces can respectively engage with at least one pawl. Two elastic members 219 and 229 is arranged between each pair of pawls to make the two pawls to open to abut onto the inside ratchet surface, to ensure that the pawls and the inside ratchet surface can engage reliably. The operating principle of the embodiment is:

FIG. 11A, 11B correspond to the first operating state of the embodiment, in which the pawl 224*b* engages with the inside ratchet surface 238, and the pawl 214*b* engages with the inside ratchet surface 235. At this point, the opening end 216*a* of the reversing member 215 pushes the pawl 214*a*, and the opening end 226*a* of the reversing member 215 pushes the pawl 224*a*, detaching from each of their inside ratchet surfaces 235, 238, so as not to serve the function.

At this point, if the handle 121 is rotated in clockwise direction, the driving gear 118 is rotated in clockwise direction, and the pawl 224*b* slides over the inside ratchet surface 238 without transferring torque to the main shaft 105. The driven gear 111 is rotated by the idle gear 128 to rotate in counterclockwise direction, and the inside ratchet surface 235 can transfer torque to the main shaft 105 through the pawl 214*b* engaging with it, to rotate the main shaft in counterclockwise direction.

If the handle 121 is rotated in counterclockwise direction, the driving gear 118 is rotated in counterclockwise direction, and the inside ratchet surface 238 can transfer torque to the main shaft 105 through the pawl 224*b* engaging with it, to rotate the main shaft in counterclockwise direction. The driven gear 111 is rotated in clockwise direction, and the pawl 214*b* slides over the inside ratchet surface 235, that is, the driven gear 111 rotates idly relative to the main shaft 105.

Therefore, no matter if the handle rotates the driving gear in clockwise direction or counterclockwise direction, in the first operating state, the main shaft 105 in the embodiment rotates in counterclockwise direction.

Figure 12B:
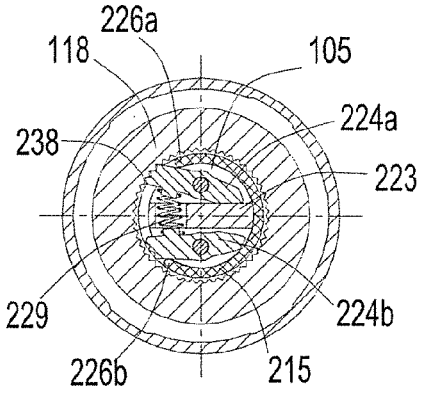

FIG. 12A, 12B correspond to the second operating state of the embodiment, in which the reversing member 21 rotates through a certain angle in clockwise direction, causing the ratchet 224*a* to engage with the inside ratchet surface 238, and the ratchet 214*a* to engage with the inside ratchet surface 235. At this point, the opening end 216*b* of the reversing member 215 pushes the pawl 214*b*, and the opening end 226*b* of the reversing member 215 pushes 224*b*, to detach them respectively from each of the inside ratchet surface 235, 238, so as to not serve function. It is known according to the same principle that no matter if the handle rotates the driving gear in clockwise direction or counterclockwise direction, in the second operating state, the main shaft rotates in clockwise direction.

Thus, by toggling the reversing member 215 in relation to the main shaft 105 and using the opening end thereof to cause a suitable pawl to engage with the inside ratchet surface, the switching between the first operating state and the second operating state can be achieved.

Embodiment Three

Figure 13A:
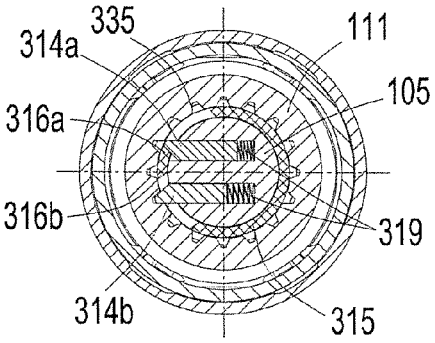
FIG. 13A is a sectional view of a reversing means corresponding to the driven gear in the first operating state of the third embodiment of the present invention, the section position referred to as positions at C-C in FIGS. 2, 3.
Figure 13B:
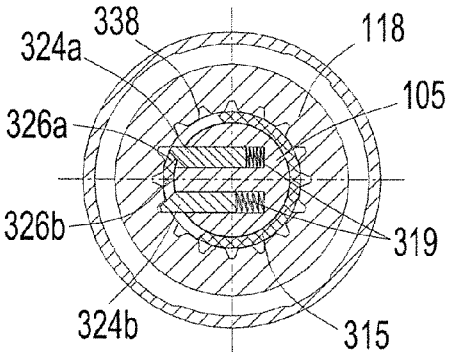
FIG. 13B is a sectional view of a reversing means corresponding to the driving gear in the first operating state of the third embodiment of the present invention, the section position referred to as positions at D-D in FIGS. 2, 3.
Figure 14A:
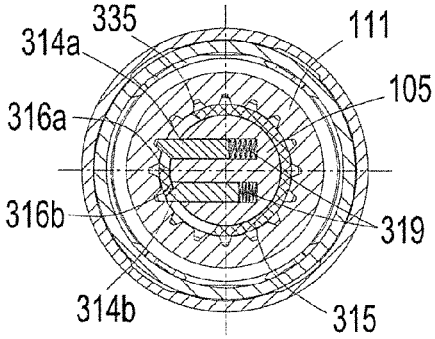
FIG. 14A is a sectional view of a reversing means corresponding to the driven gear in the second operating state of the third embodiment of the present invention, the section position referred to as positions at C-C in FIGS. 2, 3.
Figure 14B:
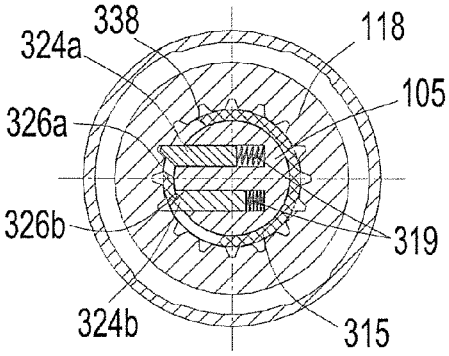
FIG. 14B is a sectional view of a reversing means corresponding to the driving gear in the second operating state of the third embodiment of the present invention, the section position referred to as positions at D-D in FIGS. 2, 3.

The embodiment is similar to Embodiment One, the only difference is that the reversing means 110 in Embodiment One is replaced to be a stopping-block reversing means as shown in FIG. 13A, 13B and FIG. 14A, 14B. Slots are provided in parallel at both sides of the axis on the main shaft 105, and a stopping block is arranged in the slot, that is, the stopping bocks 324*a* and 324*b* corresponding to the driving gear 118 shown in FIG. 13B and FIG. 14B, and the stopping blocks 314*a* and 314*b* corresponding to the driven gear 111 shown in FIG. 13A and FIG. 14A. The outside end faces of the stopping blocks 314*a* and 314*b* are inclined surfaces, and the two inclined surfaces are opposedly facing in V-shape. Openings are provided on the reversing member 315, and the end portion of the opening can push the outside end face of the stopping block, to cause the stopping block to extend or retract in the slot, so as to change the operating position of the stopping block (i.e. to set the rotation direction of the main shaft). In FIGS. 13A and 14A, the acting ends of openings of the reversing member 315 are 316*a* and 316*b*, and the opening work ends of the opening in FIGS. 13B and 14B are 326*a* and 326*b*. The acting ends of openings of the reversing member 315 are respectively located between the two V-shaped inclined surfaces. The inner circumferential surfaces of the driving gear 118 and the driven gear 111 are changed to be inside toothed surfaces 338 and 335 having a plurality of toothed portion. The two toothed surfaces can respectively engage with at least one stopping block. A spring 319 is also provided in the slot of the stopping block arranged on the main shaft 105, for pushing the stopping block outward to ensure the stopping block can reliably engage with the inside toothed surface. The principle of the embodiment is:

FIG. 13A, 13B correspond to the first operating state of the embodiment, in which the opening work end of the reversing member 315 pushes the stopping block 324*a* to retract into the slot, and the stopping block 324*b* engages with the inside toothed surface 338. The opening'acting end 316*a* of the reversing member 315 pushes the stopping block 314*a* to retract into the slot, and the stopping block 314*b* engages with the inside toothed surface 335.

At this point, if the handle 121 is rotated in clockwise direction, the driving gear 118 is rotated in clockwise direction, and the inside toothed surface 238 can transfer torque to the main shaft 105 through the stopping block 324*b* engaging with it, to rotate the main shaft in clockwise direction. The driven gear 111 is rotated by the idle gear 128 to rotate in counterclockwise direction, and the stopping block 314*b* slides over the inside toothed surface 335 without transferring torque to the main shaft 105, that is, the driven gear 111 rotated idly relative to the main shaft 105.

If the handle 121 is rotated in counterclockwise direction, the driving gear 118 is rotated in counterclockwise direction, and the stopping block 324*b* slides over the inside toothed surface 235 without transferring torque to the main shaft 105. The driven gear 111 is rotated by the idle gear 128 in clockwise direction, and the inside toothed surface 335 can transfer torque to the main shaft 105 through the stopping block 314*b* engaging with it, to rotate the main shaft in clockwise direction.

Therefore, no matter if the handle rotates the driving gear in clockwise direction or counterclockwise direction, in the first operating state, the main shaft 105 in the embodiment rotates in clockwise direction.

FIG. 14A, 14B correspond to the second operating state of the embodiment, in which the opening's acting end 326*b* of the reversing member 315 pushes the stopping block 324*b* to retract into the slot, and the stopping block 324*a* engages with the inside toothed surface 338. The opening's acting end 316*b* of the reversing member 315 pushes the stopping block 314*b* to retract into the slot, and the stopping block 314*a* engages with the inside toothed surface 335. It is known according to the same principle that no matter the handle rotates the driving gear in clockwise direction or counterclockwise direction, in the second operating state, the main shaft 105 rotates in counterclockwise direction.

Therefore, by pushing the reversing member 315 in relation to the main shaft 105 and using the acting ends of openings thereof to cause a suitable stopping block to engage with the inside toothed surface, the switching between the first operating state and the second operating state can be achieved.

Embodiment Four

Figure 15:
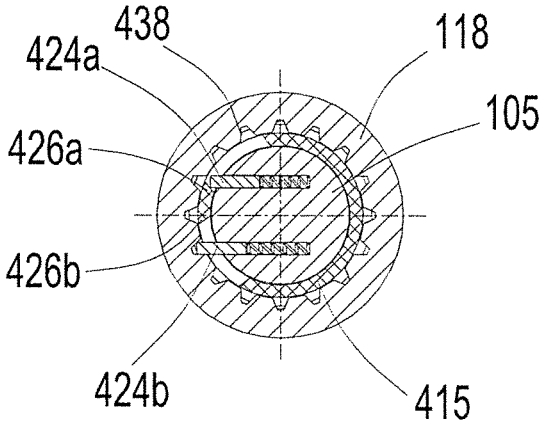
FIG. 15 is a partial sectional view of the fourth embodiment of the present invention, showing structural relationship of its main shaft, stopping block, reversing member and main gear.

The embodiment is a variation of the stopping block in Embodiment Three, that is, the outside end face of the stopping block is changed to be a plane surface. Take the components corresponding to the driving gear 118 as shown in FIG. 15 as an example, the outside end faces of the stopping blocks 424*a* and 424*b* are plane surfaces, and the opening's acting ends 426*a* and 426*b* of the reversing member 415 are located between the two stopping blocks, being able to push the outside end face of the stopping block, to cause the stopping block to extend and retract in the slot, so as to change the operating positions of the stopping block (i.e. to set the rotation direction of the main shaft). The inside toothed surface 438 of the driving gear 118 can engage with at least one stopping block. It can be understood by the person skilled in the art that the operating principle of the embodiment is the same as that of Embodiment Three, also being able to achieve the object of the present invention.

Embodiment Five

Figure 16:
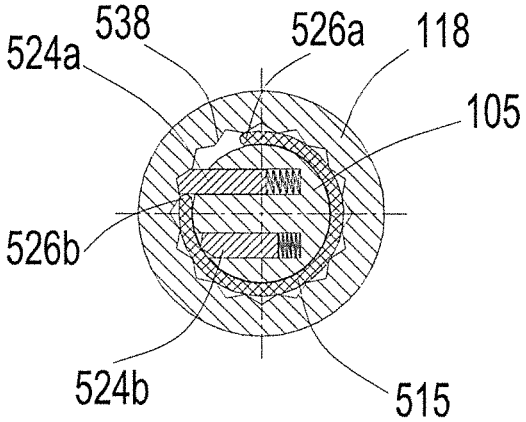
FIG. 16 is a partial sectional view of the fifth embodiment of the present invention, showing structural relationship of its main shaft, stopping block, reversing member and main gear.
Figure 17A:
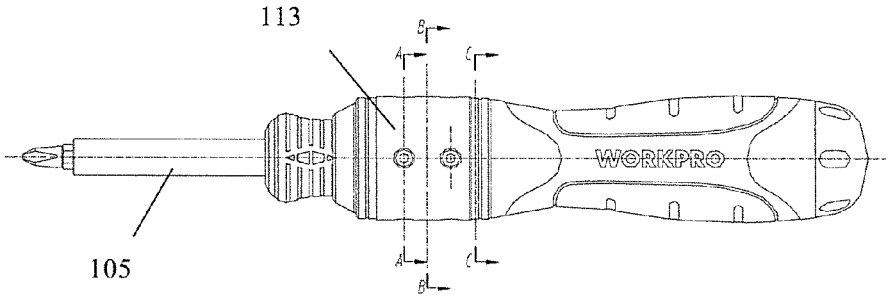
FIG. 17A is a side view of the sixth embodiment of the present invention, in which the push button in the rear.
Figure 17B:
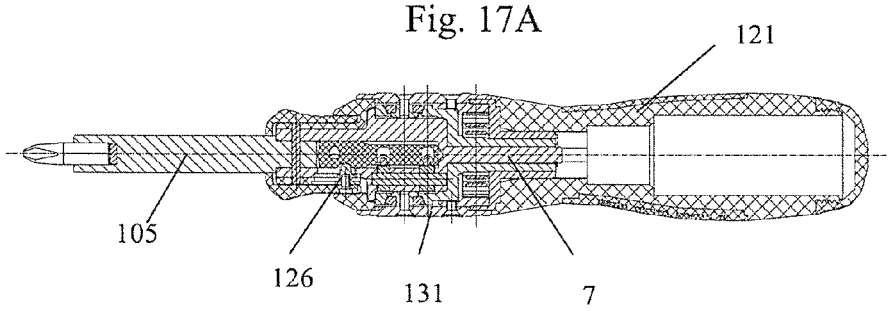
FIG. 17B is a side sectional view of the sixth embodiment of the present invention, in which the push button in the rear.
Figure 17C:
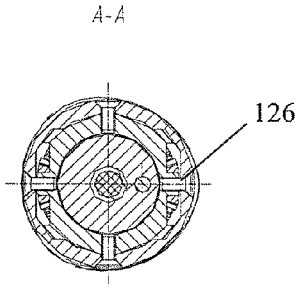
FIG. 17C is a transverse sectional view of point A of the sixth embodiment of the present invention, in which the push button in the rear.
Figure 17D:
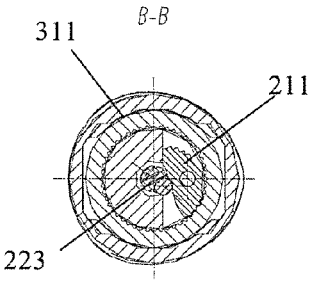
FIG. 17D is a transverse sectional view of point B of the sixth embodiment of the present invention, in which the push button in the rear.
Figure 17E:
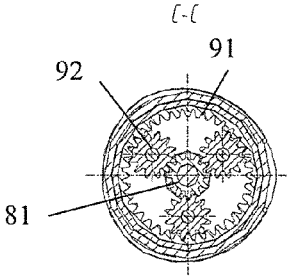
FIG. 17E is a transverse sectional view of point C of the sixth embodiment of the present invention, in which the push button in the rear.
Figure 18A:
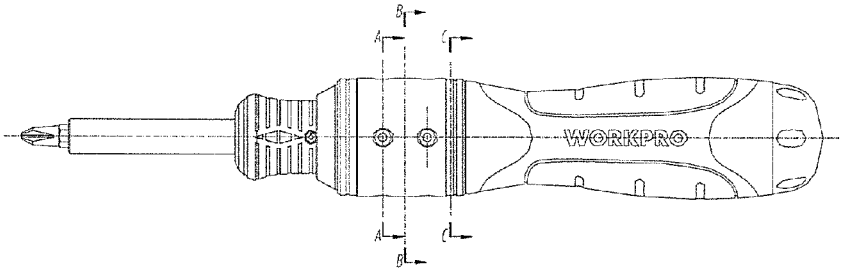
FIG. 18A is a side view of the sixth embodiment of the present invention, in which the push button in the front.
Figure 18B:
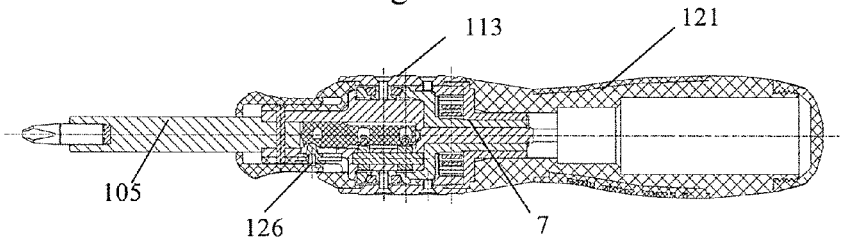
FIG. 18B is a side sectional view of the sixth embodiment of the present invention, in which the push button in the front.
Figure 18C:
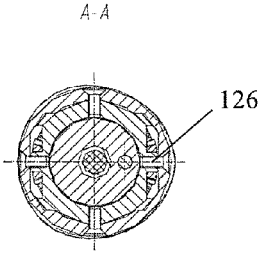
FIG. 18C is a transverse sectional view of point A of the sixth embodiment of the present invention, in which the push button in the front.
Figure 18D:
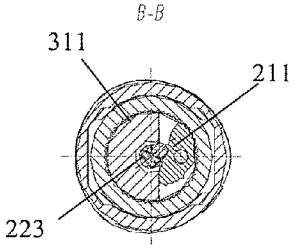
FIG. 18D is a transverse sectional view of point B of the sixth embodiment of the present invention, in which the push button in the front.
Figure 18E:
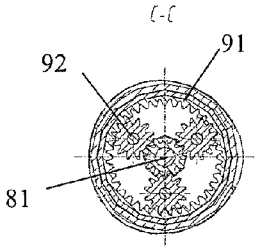
FIG. 18E is a transverse sectional view of point C of the sixth embodiment of the present invention, in which the push button in the front.
Figure 19:
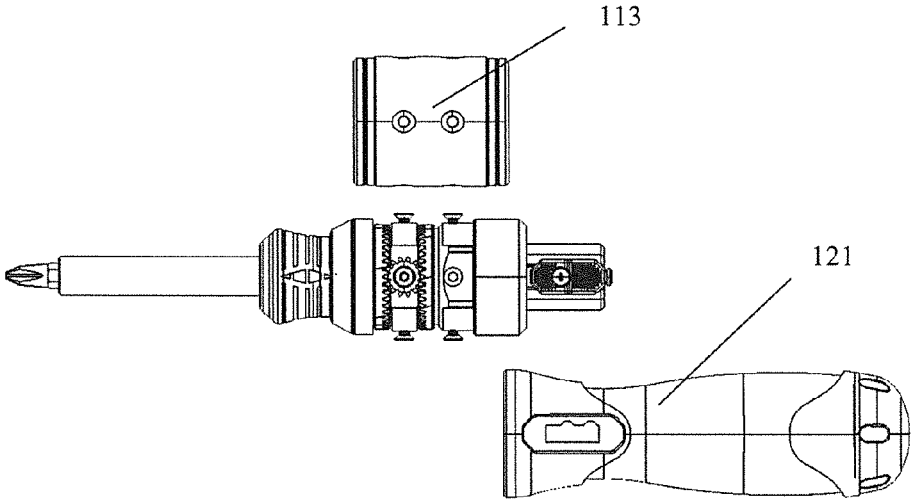
FIG. 19 is an exploded view of the sixth embodiment of the present invention.

The embodiment is a variation of the stopping block and the reversing member in Embodiment Three. Take the component corresponding to the driving gear 118 as shown in FIG. 16 as an example, the outside end faces of the stopping blocks 524*a* and 524*b* are of a tooth form that engage with the inside toothed surface 538 of the driving gear 118, and the opening's acting ends 526*a* and 526*b* of the reversing member 515 are located outside of the two stopping blocks, being able to push the outside end face of the stopping block, to cause the stopping block to extend or retract in the slot, so as to change the operating position of the stopping block (i.e. to set the rotation direction of the main shaft). The inside toothed surface 538 of the driving gear 118 can engage with at least one stopping block. It can be understood by the person skilled in the art that the operating principle of the embodiment is the same as that of the Embodiment Three, also being able to achieve the object of the present invention.

Embodiment Six

Figure 24:
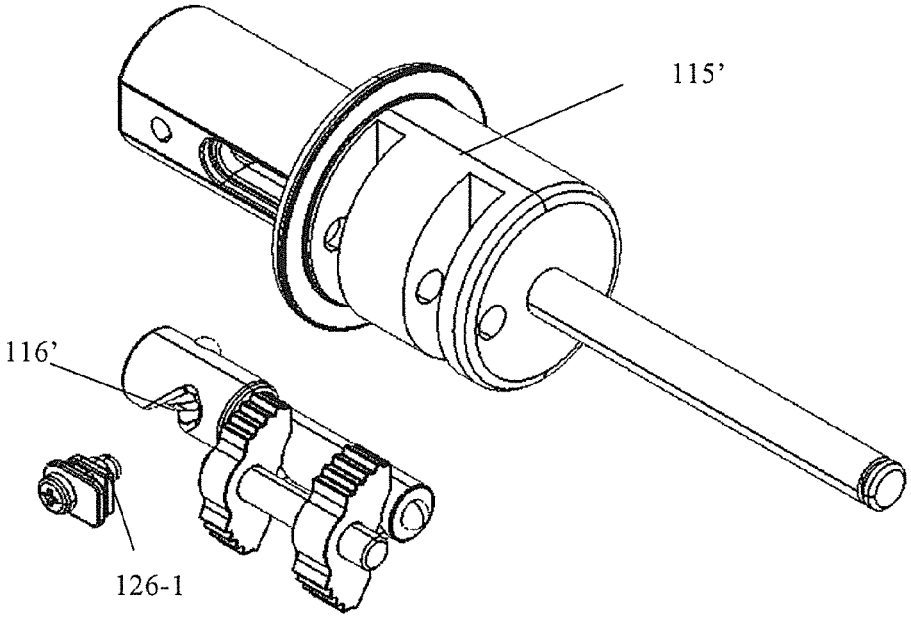
FIG. 24 is exploded view One of the reversing means of the sixth embodiment of the present invention.
Figure 25:
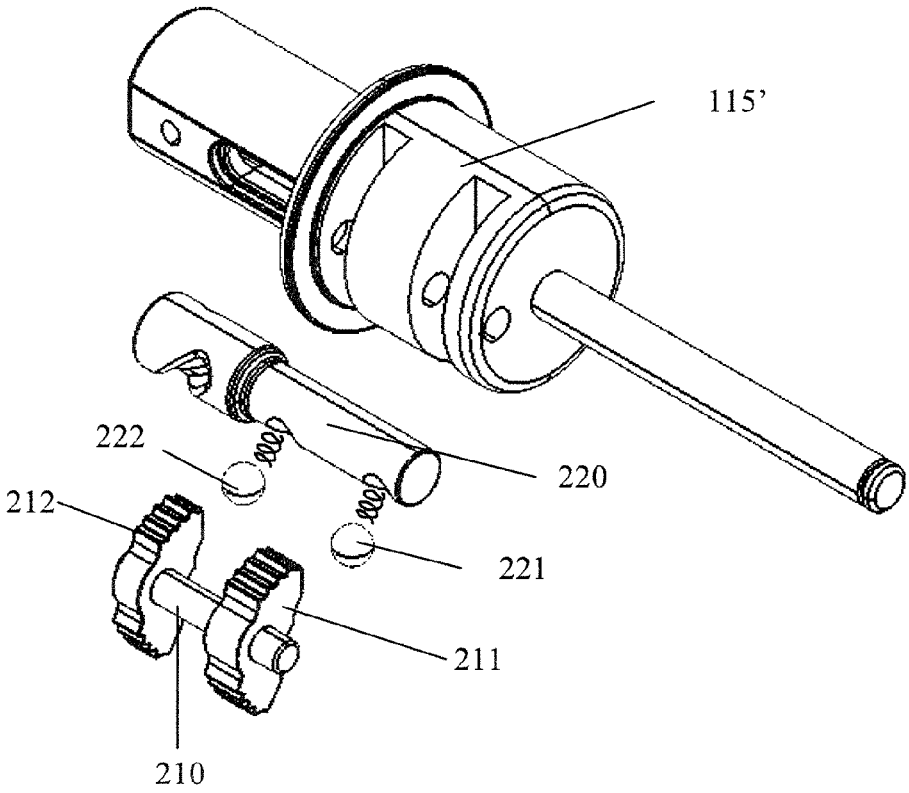
FIG. 25 is exploded view Two of the reversing means of the sixth embodiment of the present invention.

The embodiment discloses another reversing means, as shown in FIGS. 17-26, in which the reversing means 110' is sleeved with a transmission mechanism 130 about the outside. The reversing means 110' includes a reversing member 115', a central shaft 220, a first ball plug 221 and a second ball plug 222 constituting a reversing switch, and a first pawl member 211 and a second pawl member 212, in which the main shaft 105 and the central shaft 220 are sleeved with the reversing member, and they can rotate together; the first ball plug 221 and the second ball plug 222 are secured on the central shaft 220 at intervals. Preferably, an elastic member such as a spring, etc. is fitted between the first ball plug 221 and the second ball plug 222 and the central shaft. The first pawl member 211 and the second pawl member 212 are mounted on the reversing member 115' through a secondary shaft 210, as shown in FIG. 25, the secondary shaft 210 are parallel to the reversing member 115' but its central axis is not coincident with the central axis of the reversing member 115', and the first pawl member 211 and the second pawl member 212 are rotatable about the secondary shaft 210.

Figure 26:
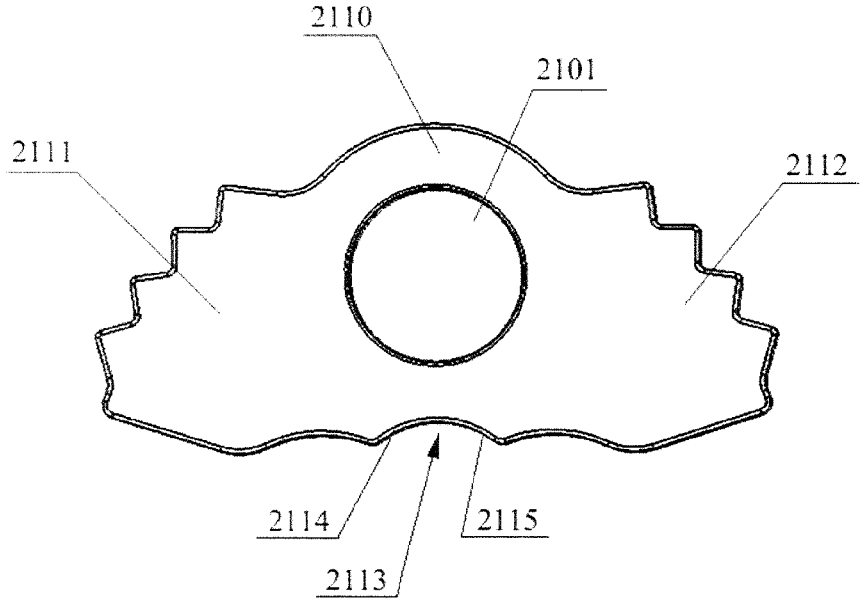
FIG. 26 is a top view of the ratchet member in the reversing means of the sixth embodiment of the present invention.
Figure 27:
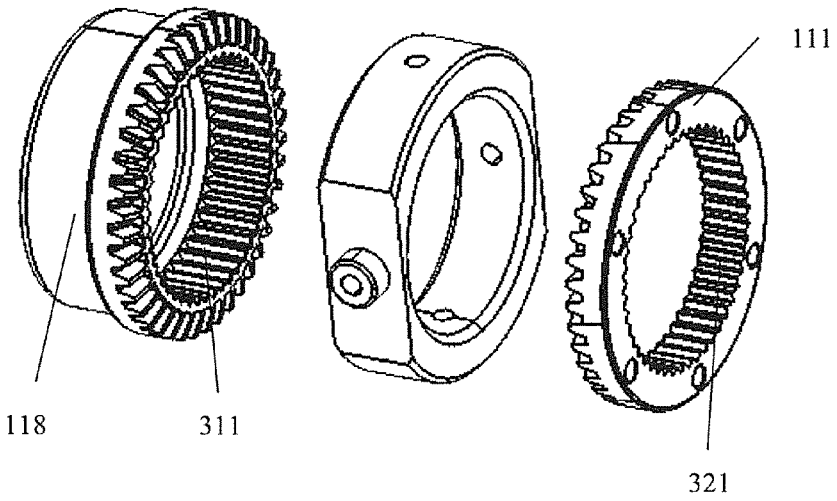
FIG. 27 is a partial exploded view of the gearing of the present invention.

The first pawl member 211 and the second pawl member 212 have similar structures, both including a first fan-shaped pawl, a second fan-shaped pawl and the fan-shaped middle portion therebetween. Take the first pawl member 211 as an example, FIG. 26 shows a top view of the first pawl member 211, and it can be seen from FIG. 26 that the first pawl member 211 includes a first fan-shaped pawl 2111, a second fan-shaped pawl 2112 and a fan-shaped middle portion 2110 therebetween. The fan-shaped toothed surface of the first fan-shaped pawl 2111, the fan-shaped surface of the fan-shaped middle portion 2110 and the fan-shaped toothed surface of the second fan-shaped pawl 2112 constitute a first surface of the first pawl member 211. The first pawl member 211 also includes a second surface, that is, bottom surface, which is a shaped surface. In the embodiment the shaped includes a recess 2113 having a first side wall 2114 and a second side wall 2115. A via hole engaging with the secondary shaft 210 is provided in the first pawl member 211, and the secondary passes through the via hold 2101 and mounts the first pawl member 211 on the reversing member 115'. In the embodiment, the via hole 2101 is arranged at the fan-shaped middle portion of the first pawl member 211, preferably, at the center of gravity of the first pawl member 211. The structure of the second pawl member 212 is similar to the first pawl member 211, which are not described here, in the embodiment, its thickness is smaller than the thickness of the first pawl member 211, but in other embodiments, its thickness can be equal to the thickness of the first pawl member 211, or greater than the thickness of the first pawl member 211.

The first surfaces of the first pawl member 211 and the second pawl member 212 face the toothed surfaces of the first ratchet surface 311 at the inside of the driving gear 118 and the second ratchet surface 321 at the inside of the driven gear 111, respectively. Specifically, the teeth of the fan-shaped pawl of the first pawl member 211 (including the first fan-shaped pawl 2111 and the second fan-shaped pawl 2112) face the teeth of the first ratchet surface 311, and the teeth of the fan-shaped pawl (including the first fan-shaped pawl and the second fan-shaped pawl) of the second pawl member 212 face the teeth of the second ratchet surface 321. The second surfaces of the first pawl member 211 and the second pawl member 212 face the surface of the central shaft 220 respectively. Specifically, the second surface of the first pawl member 211 faces the first ball plug 221, and the second surface of the second pawl member 212 faces the second ball plug 222. By rotating the central shaft 220, the first ball plug 221 is caused to come into contact with the first side wall 2114 of the recess 2113 of the first pawl member 211, and at the same time, the second ball plug 222 is caused to come into contact with the first side wall of the recess of the second pawl member 212. At this point the bi-directional screwdriver of the present invention is in the first operating mode; or, the first ball plug 221 is caused to come into contact with the second side wall 2115 of the recess 2113 of the first pawl member 211, and at the same time the second ball plug 222 is caused to come into contact with the second side wall of the recess of the second pawl member 212. At this point the bi-directional screwdriver of the present invention is in a second operating mode.

When the bi-directional screwdriver of the present invention is in the first operating mode, as shown in FIGS. 17A-17E, the teeth of the first fan-shaped pawl 2111 of the first pawl member 211 comes into contact with the teeth of the first ratchet surface 311, and likewise, the teeth of the first fan-shaped pawl of the second pawl member 212 comes into contact with the teeth of the second ratchet surface 321. When the handle causes the first ratchet surface 311 of the driving gear 118 to rotate, and when the moving direction of the teeth of the first ratchet surface 311 at the first fan-shaped pawl 2111 is directing at the second fan-shaped portion 2112 from the first fan-shaped portion 2111, because the first ball plug 211 contacts the first side wall 2114 of the recess 2113 of the first pawl member 211 when the first ratchet surface 311 rotates in clockwise direction, the first ratchet surface 311 cannot cause the first pawl member 211 to rotate with it together, that is, the teeth of the first fan-shaped pawl 2111 do not engage with the teeth of the first ratchet surface 311 for transmission; and when the moving direction of the teeth of the first ratchet surface 311 at the first fan-shaped pawl 2111 is directing at the first fan-shaped portion 2111 from the second fan-shaped portion 2112, that is, when the first ratchet surface 311 rotates in counterclockwise direction, because the first ball plug 211 contacts the first side wall 2114 of the recess 2113 of the first pawl member 211, the first ratchet surface 311 can cause the first pawl member 211 to rotate with it together, that is, the teeth of the first fan-shaped pawl 2111 engages with the teeth of the first ratchet surface 311 for transmission. The rotation of the first pawl member 211 is transferred to the reversing member 115' through the secondary shaft 210, so as to rotate the reversing member 115'.

At the same time, when the moving direction of the teeth of the second ratchet surface 321 at the first fan-shaped pawl of the second pawl member 212 is directing at the second fan-shaped portion from the first fan-shaped portion of the second pawl member 212, that is, when the second ratchet surface 321 rotates in clockwise direction, because the second ball plug 222 contacts the first side wall of the recess of the second pawl member 212, the second ratchet surface 321 cannot cause the second pawl member 212 to rotate with it together, that is, the teeth of the first fan-shaped pawl of the second ratchet member 212 do not engage with the teeth of the second ratchet surface 321 for transmission; and when the moving direction of the teeth of the second ratchet surface 321 at the first fan-shaped pawl of the second pawl member 212 is directing at the first fan-shaped portion from the second fan-shaped portion of the second pawl member 212, that is, when the second ratchet surface 321 rotates in counterclockwise direction, because the second ball plug 222 contacts the first side wall of the recess of the second pawl member 212, the second ratchet surface 321 can cause the second pawl member 212 to rotate with it together, that is, the teeth of the first fan-shaped pawl of the second pawl member 212 engages with the teeth of the second ratchet surface 321 for transmission. The rotation of the second pawl member 212 is transferred to the reversing member 115' through the secondary shaft 210, so as to rotate the reversing member 115'.

Because of the aforementioned transmission among the idle gear 128 and the driving gear 118 and the driven gear 111, when the grip ring 113 is stationary, the rotation direction of the second ratchet surface 321 is reverse to the first ratchet surface 311. It thus can be known that in the first operating mode of the present invention, when the inputted torque from the handle is clockwise torque, it causes the first ratchet surface 311 to rotate in clockwise direction, and the second ratchet surface 321 in counterclockwise direction. At this point the first pawl member 211 does not connect with the first ratchet surface 311, and the second pawl member 212 connects with the second ratchet surface 321. Therefore, the second pawl member 212 rotates the reversing member 115' in counterclockwise direction, and the outputted torque is counterclockwise torque; when the inputted torque from the handle is counterclockwise torque, it causes the first ratchet surface 311 to rotate in counterclockwise direction, and the second ratchet surface 321 in clockwise direction. At this point the first pawl member 211 connects with the first ratchet surface 311, and the second pawl member 212 does not connect with the second ratchet surface 321. Therefore, the first pawl member 211 rotates the reversing member 115' in counterclockwise direction, and the outputted torque is counterclockwise torque.

When the bi-directional screwdriver of the present invention is in the second operating mode, as shown in FIGS. 18A-18E, the teeth of the second fan-shaped pawl 2112 of the first pawl member 211 come into contact with the teeth of the first ratchet surface 311, and likewise, the teeth of the second fan-shaped pawl of the second pawl member 212 come into contact with the teeth of the second ratchet surface 321. When the inputted torque from the handle causes the first ratchet surface 311 to rotate, and when the moving direction of the teeth of the first ratchet surface 311 at the second fan-shaped pawl 2112 is directing at the second fan-shaped portion 2112 from the first fan-shaped portion 2111, that is, when the first ratchet surface 311 rotates in clockwise direction, because the first ball plug 221 contacts the second side wall 2115 of the recess 2113 of the first pawl member 211, the first ratchet surface 311 cause the first pawl member 211 to rotate with it together, that is, the teeth of the second fan-shaped pawl 2112 engages with the teeth of the first ratchet surface 311 for transmission; the rotation of the first pawl member 211 is transferred to the reversing member 115' through the secondary shaft 210, so as to rotate the reversing member 115'. When the moving direction of the teeth of the first ratchet surface 311 at the second fan-shaped pawl 2112 is directing at the first fan-shaped portion 2111 from the second fan-shaped portion 2112, that is, when the first ratchet surface 311 rotates in counterclockwise direction, because the first ball plug 221 contacts the first side wall 2115 of the recess 2113 of the first pawl member 211, the first ratchet surface 311 cannot cause the first pawl member 211 to rotate with it together, that is, the teeth of the second fan-shaped pawl 2112 do not engage with the teeth of the second ratchet surface 311 for transmission.

At the same time, when the moving direction of the teeth of the second ratchet surface 321 at the second fan-shaped pawl of the second pawl member 212 is directing at the second fan-shaped portion from the first fan-shaped portion of the second pawl member 212, that is, when the second ratchet surface 321 rotates in clockwise direction, because the second ball plug 222 contacts the second side wall of the recess of the second pawl member 212, the second ratchet surface 321 can cause the second pawl member 212 to rotate with it together, that is, the teeth of the second fan-shaped pawl of the second ratchet member 212 engage with the teeth of the second ratchet surface 321 for transmission; the rotation of the second pawl member 212 is transferred to the reversing member 115' through the secondary shaft 210, so as to rotate the reversing member 115'. When the moving direction of the teeth of the second ratchet surface 321 at the second fan-shaped pawl of the second pawl member 212 is directing at the first fan-shaped portion from the second fan-shaped portion of the second pawl member 212, that is, when the second ratchet surface 321 rotates in counterclockwise direction, because the second ball plug 222 contacts the second side wall of the recess of the second pawl member 212, the second ratchet surface 321 cannot cause the second pawl member 212 to rotate with it together, that is, the teeth of the first fan-shaped pawl of the second pawl member 212 do not engage with the teeth of the second ratchet surface 321 for transmission.

Because of the aforementioned transmission among the idle gear 128 and the driving gear 118 and the driven gear 111, when the grip ring 113 is stationary, the rotation direction of the second ratchet surface 321 is reverse to the first ratchet surface 311. It thus can be known that in the second operating mode of the present invention, when the inputted torque from the handle is clockwise torque, it causes the first ratchet surface 311 to rotate in clockwise direction, and the second ratchet surface 321 in counterclockwise direction. At this point the first pawl member 211 connects with the first ratchet surface 311, and the second pawl member 212 does not connect with the second ratchet surface 321. Therefore, the first pawl member 211 rotates the reversing member 115' in clockwise direction, and the outputted torque is clockwise torque; when the inputted torque from the handle is counterclockwise torque, it causes the first ratchet surface 311 to rotate in counterclockwise direction, and the second ratchet surface 321 to rotate in clockwise direction. At this point the first pawl member 211 does not connect with the first ratchet surface 311, and the second pawl member 212 connects with the second ratchet surface 321. Therefore, the first pawl member 211 rotates the reversing member 115' in counterclockwise direction, and the outputted torque is clockwise torque.

As aforementioned, by rotating the central shaft 220, the bi-directional screwdriver of the present invention can switch and select between the first operating mode and the second operating mode. For the convenient of use, in the embodiment, a helical sliding slot 116' is arranged at the front end of the central shaft 220. The head cover 108 is arranged with a sliding slot which is parallel to the axis of the main shaft 105. The sliding slot is provided with a push button assembly 126 which is slidable along the sliding slot, for controlling the position of the central shaft so as to set the rotation direction of the main shaft 105.

The push button assembly 126 achieves the controlling of the central shaft 220 through a spatial cam mechanism. As shown in FIG. 24, a helical sliding slot 116' is arranged on the outer circumferential surface of the central shaft 220. The push button assembly 126 has a portion extending into the sliding slot 116', such as arm 126-1 or a steel ball, so as to constitute a cam mechanism that converts the axial lineal movement of the push button assembly 126 to the circular movement of the central shaft 220, that is, by toggling the push button assembly 126 along the axis, the arm 126-1 extending into the sliding slot 116' causes the central shaft to be in circling motion.

Above noted are several embodiments of a screwdriver having bi-directional mechanical converter, which is also suited for wrenches, especially with Embodiment Six. No matter which direction of the rotation torque inputted from the screwdriver or wrench is, the bi-directional mechanical converter transfers torque to the main shaft of screwdriver or wrench for output according to a predetermined direction.

On the basis of the above screwdriver or wrench having bi-directional mechanical converter, the present invention further provides a bi-directional screwdriver or wrench having speed increasing mechanism. A speed increasing bi-directional screwdriver is described in the following with reference to embodiments.

FIGS. 17-21 show an embodiment of the speed increasing bi-directional screwdriver, and it can be seen from the figures that on the basis of the above bi-directional screwdriver, the screwdriver also has a speed increasing mechanism, and further includes a speed increasing switch 5. When the speed increasing switch 5 is turned on, the rotation inputted from the handle 121 is speeded up before being transferred into the bi-directional mechanical converter; when the speed increasing switch 5 is turned off, the rotation inputted from the handle 121 is directly transferred into the bi-directional mechanical converter.

Figure 20:
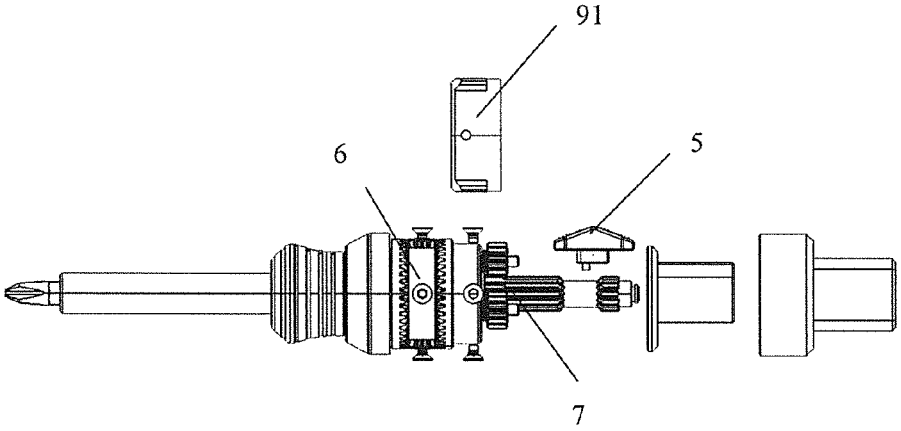
FIG. 20 is an exploded side view of the sixth embodiment, in which the grip ring and the handle is removed.
Figure 21:
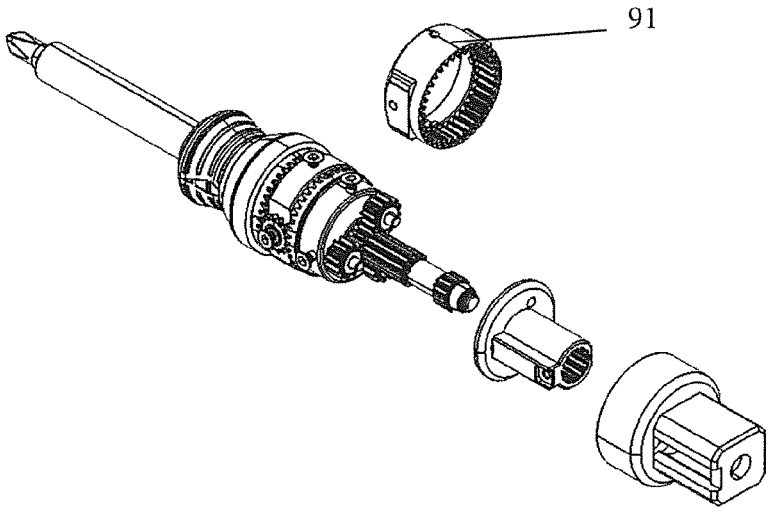
FIG. 21 is an exploded perspective view of the sixth embodiment, in which the grip ring and the handle is removed.
Figure 22:
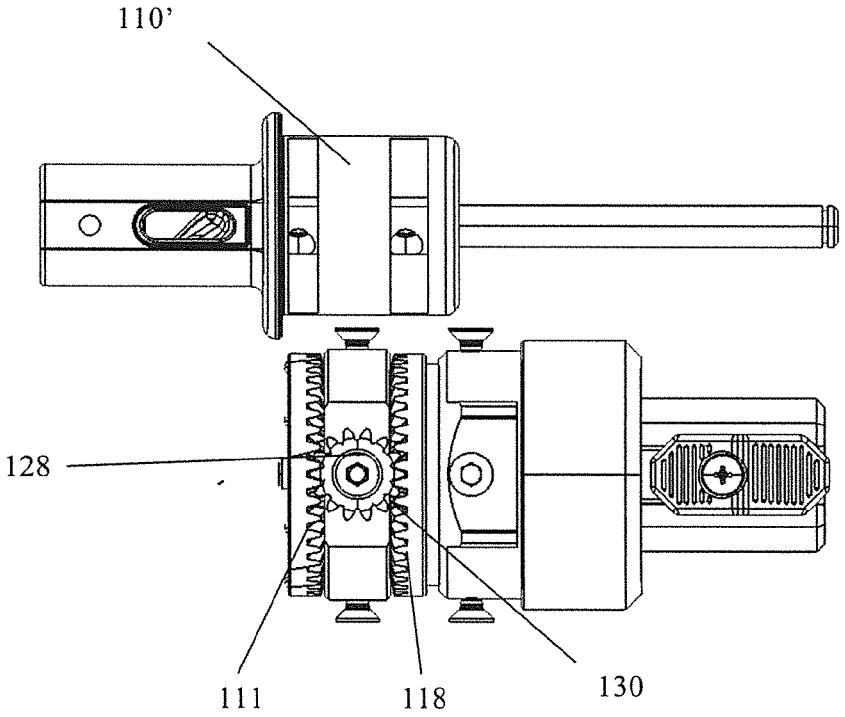
FIG. 22 is an exploded view of the reversing means and gearing of the sixth embodiment of the present invention.
Figure 23:
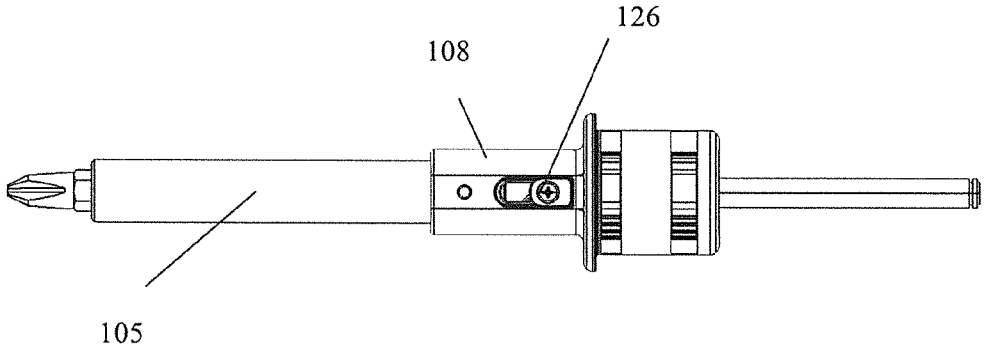
FIG. 23 is a schematic view of the reversing means of the sixth embodiment of the present invention.

FIG. 20 shows the screwdriver after removing the handle 121, the grip ring 113. The visible part 6 is an embodiment of a bi-directional mechanical converter as aforementioned, which is not described here. And the part 7 related to the part 6 is the speed increasing mechanism part, which will be described as follows.

Figure 28:
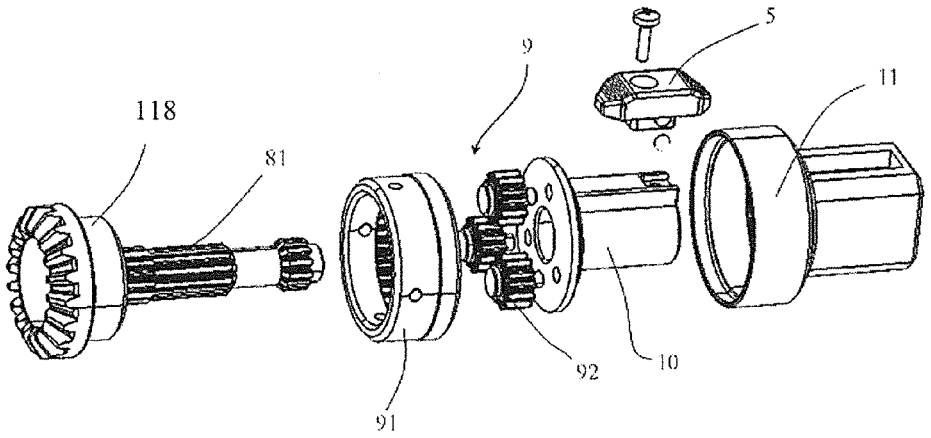
FIG. 28 is an exploded view of the speed increasing mechanism of the present invention.
Figure 29:
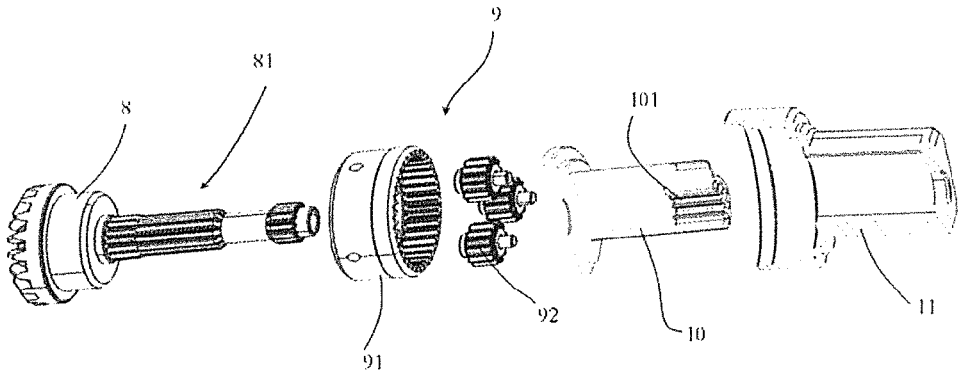
FIG. 29 is a sectional view of the speed increasing mechanism of the present invention.

FIGS. 28 and 29 are exploded view of the speed increasing mechanism 7. FIG. 8 shows the driving gear 118 of the bi-directional mechanical converter, which is arranged with a gear shaft 81 at the tail part. It requires to be explained that although in the embodiment the gear shaft 81 is not integrated with the driving gear 118, but in other embodiments, the integrated connection can be used to allow the gear shaft 81 to cause the driving gear 118 to rotate together. Referring to FIGS. 28 and 29, the gear shaft 81 is sleeved with a speed increasing planetary gear mechanism 9 thereon which includes a gear ring 91 securely connected to the grip ring 113, three planetary gears 92 engaged between the gear shaft 81 and the gear ring 91, and a planetary carrier sleeve 10. The gear shaft 81 serves as a sun gear in the speed increasing planetary gear mechanism at this point. When the operator holds the grip ring 113 and rotates the handle 2, the gear ring 91 is stationary, and the handle transfers the rotation to the planetary carrier sleeve 10 which rotates the planetary gear 92 which rotates the gear shaft 81 to rotate with speed increasing. In the embodiment, if the gear ring 91 is stationary, the rotation is inputted by the planetary gear 92, and outputted by the sun gear i.e. the gear shaft 81.

In the embodiment, the number of the teeth of the gear ring 91 is 36, and the number of the teeth of the gear of the planetary gear 92 is 12, and thereby the speed increasing planetary gear mechanism 9 causes the rotation inputted from the handle 2 to be increased by four times of speed and then the rotation is transferred to the driving gear 8 of the bi-directional mechanical converter. In other embodiments, other speed ratio can be configured according to actual requirements.

In the screwdriver of the embodiment, although the rotation speed of the main shaft 105 is increased through speed increasing mechanism 7, the screwdriver operating efficiency under low torque requirement operating situations can be improved, whereas with the increase of the rotation speed, the outputted torque of the screwdriver is decreasing, it cannot meet the requirement of use under high torque requirement operation situation. Therefore, in the embodiment, the speed increasing mechanism part 7 is further arranged with a clutching feature, that is, to cause the speed increasing mechanism to engage when under low torque requirement operation situation so as to improve the rotation speed outputted by the screwdriver, and to detach when under high torque requirement operation situation so as to increase the outputted torque by the screwdriver. The realizing of the clutching feature in the embodiment will be described as follows.

Figure 30:
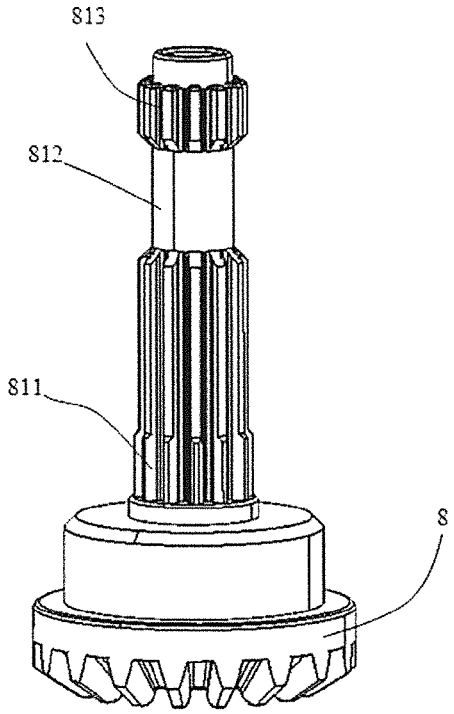
FIG. 30 is a schematic view of the gear shaft of the present invention.

As shown in FIG. 30, the gear shaft 81 includes three parts: a first gear surface 811 engaging with the planetary gear 92, a smooth surface 812 and a second gear surface 813. An inner gear 101 is arranged on the inner circumferential surface of the planetary carrier sleeve 10, which can be driven by the speed increasing switch 5 to slide between the engaging and detaching positions on the gear shaft 81. When the planetary carrier sleeve 10 slides to the engaging position, the planetary carrier sleeve 10 engages with the planetary gear 92 and rotates the planetary gear 92. At this point, the inner gear 101 is located at the smooth surface 812 on the gear shaft 81; when the planetary carrier sleeve slides to the detaching position, the planetary carrier sleeve 10 detaches from the planetary gear 92 without rotating the planetary gear 92, and the inner gear 101 is located at the second gear surface 813 and engages with it, so that the inputted rotation by the handle 121 can be directly transferred to the driving gear 118, and keep the original torque without being speed-increased by the speed increasing mechanism 7.

In the embodiment, an outer sleeve 11 is provided about the outside the planetary carrier sleeve 10, a handle 121 is sleeved on the outside of the outer sleeve 11, the rotating inputted by the handle 121 is transferred to the planetary carrier sleeve 10 through the outer sleeve 11. It can be understood by the person skilled in the art that, in other embodiments, other connection method can be used between the handle 2 and the planetary carrier sleeve 10 to transfer the inputted rotation to the planetary carrier sleeve 10.

The invention has been exemplified above with reference to specific embodiments. However, it should be understood that a multitude of modifications and varieties can be made by a common person skilled in the art based on the conception of the present invention. Therefore, any technical schemes, acquired by the person skilled in the art based on the conception of the present invention through logical analyses, deductions or limited experiments, fall within the scope of the invention as specified in the claims.

The invention claimed is:

1. A bi-directional screwdriver, comprising: a handle, a main shaft, a gearing which comprises a driving gear, a driven gear, a transmission seat and an idle gear which is mounted on an idle gear axle on the transmission seat and is fitted between the driving gear and the driven gear for transferring motion, wherein the handle rotates the driving gear, and a grip ring is securely disposed outside the idle gear axle, and when the grip ring is rotating relative to the handle, the driving gear is rotated and rotates the driven gear in a reverse direction through the idle gear, wherein the driving gear also has a first inside ratchet surface, and the driven gear also has a second inside ratchet surface;

further comprising a reversing means which includes a reversing member, a first pawl member and a second pawl member, and a reversing switch, wherein the driving gear, the driven gear and the transmission seat are all sleeved on the reversing member, and the reversing member is sleeved on the main shaft, being able to rotate the main shaft;

wherein the first pawl member is provided with a first pawl and a second pawl selectively engaging with the first ratchet surface, wherein the first pawl slides over the first ratchet surface in a first direction, while engaging with the first ratchet surface for transmission in a second direction, and the second pawl engages with the first ratchet surface for transmission in the first direction, while sliding over the first ratchet surface in the second direction;

wherein the second pawl member is provided with a third pawl and a fourth pawl selectively engaging with the second ratchet surface, wherein the third pawl slides over the second ratchet surface in the first direction, while engaging with the second ratchet surface for transmission in the second direction, and the fourth pawl engages with the second ratchet surface for transmission in the first direction, while sliding over the second ratchet surface in the second direction;

wherein the reversing switch can set the first pawl member and the second pawl member in a first state and a second state, in the first state, the first pawl and the third pawl respectively engage with the first ratchet surface and the second ratchet surface at the same time; in the second state, the second pawl and the fourth pawl respectively engage with the first ratchet surface and the second ratchet surface at the same time;

wherein the first direction is a clockwise or counterclockwise direction, and the second direction is a reverse direction of the first direction;

wherein the reversing switch comprises a central shaft, a first ball plug and a second ball plug;

a front end of the central shaft is provided with a helical sliding slot, the bi-directional screwdriver further comprises a head cover sleeved on a front end of the reversing member, a guide way parallel to the axis of the main shaft is provided on the head cover, and a push button assembly slidable along the guide way and the sliding slot is provided in the guide way for controlling a position of the central shaft so as to set a rotation direction of the main shaft.

2. The bi-directional screwdriver as in claim 1, wherein the first pawl member and/or the second pawl member are fan-shaped, wherein the first pawl and the second pawl, the third pawl and the fourth pawl are fan-shaped toothed surfaces.

3. The bi-directional screwdriver as in claim 2, wherein the central shaft is provided through an inside of the reversing member, the first ball plug and the second ball plug are secured to the central shaft successively, the first ball plug and the second ball plug engage with recesses on the bottom surfaces of the fan-shaped first pawl member and the second pawl member respectively.

4. The bi-directional screwdriver as in claim 3, wherein an elastic member is fitted between the first and the second ball plug and the central shaft.

5. The bi-directional screwdriver as in claim 4, wherein the first pawl member and the second pawl member are mounted on a secondary shaft and the secondary shaft is parallel to the reversing member.

6. The bi-directional screwdriver as in claim 1, further comprising a speed increasing mechanism comprising a gear shaft arranged at a tail part of the driving gear and a speed increasing planetary gear mechanism which comprises a gear ring securely connected to the grip ring, three planetary gears engaging between the gear shaft and the gear ring, and a planetary carrier sleeve connected to the handle, when the gear ring rotates relative to the handle, the planetary carrier sleeve rotating the planetary gears which rotates the gear shaft in increased speed, and the gear shaft inputting a speeded-up rotation to the driving gear.

7. The bi-directional screwdriver as in claim 6, wherein the gear shaft has thereon a first gear surface engaging with the planetary gears, a smooth surface and a second gear surface, an internal gear is provided on an inner circumferential surface of the planetary carrier sleeve which is arranged able to slide between an engaging position and a disengaged position on the gear shaft, when the planetary carrier sleeve slides to the engaging position, the planetary carrier sleeve engages with the planetary gears and the internal gear is located on the smooth surface of the gear shaft at the moment; when the planetary carrier sleeve slides to the disengaged position, the planetary carrier sleeve is disengaged from the planetary gears and the internal gear is located at the second gear surface and engages therewith.

8. The bi-directional screwdriver as in claim 7, further comprising a speed increasing switch for driving the planetary carrier sleeve to slide between the engaging position and the disengaged position.

9. The bi-directional screwdriver as in claim 8, wherein an outer sleeve is further provided outside the planetary carrier sleeve, and the handle is sleeved on an outside of the outer sleeve.

10. A bidirectional screwdriver, comprising:

a handle, a main shaft, a gearing which comprises a driving gear, a driven gear, a transmission seat and an idle gear which is mounted on an idle gear axle on the transmission seat and is fitted between the driving gear and the driven gear for transferring motion, wherein the handle rotates the driving gear, and a grip ring is securely disposed outside the idle gear axle, and when the grip ring is rotating relative to the handle, the driving gear is rotated and rotates the driven gear in a reverse direction through the idle gear;

further comprising a reversing member, a first pawl member, a second pawl member and a reversing switch;

the handle outputs torque to the main shaft through the reversing member, the first pawl member and the second pawl;

wherein the first pawl member is provided with a first pawl and a second pawl engaging with a first ratchet surface, wherein the first pawl slides over the first ratchet surface in a first direction, while engaging with the first ratchet surface for transmission in a second direction, and the second pawl engages with the first ratchet surface for transmission in the first direction, while sliding over the first ratchet surface in the second direction;

the second pawl member is provided with a third pawl and a fourth pawl engaging with a second ratchet surface, wherein the third pawl slides over the second ratchet surface in the first direction, while engaging with the second ratchet surface for transmission in the second direction, and the fourth pawl engages with the second ratchet surface for transmission in the first direction, while sliding over the second ratchet surface in the second direction;

wherein the reversing switch can set the first pawl member and the second pawl member in a first state and a second state, in the first state, the first pawl and the third pawl respectively engage with the first ratchet surface and the second ratchet surface at the same time; in the second state, the second pawl and the fourth pawl respectively engage with the first ratchet surface and the second ratchet surface at the same time;

the first direction is a clockwise or counterclockwise direction, and the second direction is a reverse direction of the first direction;

wherein the reversing switch comprises a central shaft, a first ball plug and a second ball plug;

a front end of the central shaft is provided with a helical sliding slot, the bi-directional screwdriver further comprises a head cover sleeved on a front end of the reversing member, a guide way parallel to the axis of the main shaft is provided on the head cover, and a push button.

11. The bi-directional screwdriver as in claim 10, wherein the driving gear and the driven gear connect to a one-way clutch respectively.

12. The bi-directional screwdriver as in claim 11, wherein the one-way clutch includes the first pawl, the second pawl, the third pawl and the fourth pawl, as well as the first ratchet surface and the second ratchet surface engaging with the first pawl, the second pawl, the third pawl and the fourth pawl.

13. The bi-directional screwdriver as in claim 12, wherein the reversing member has openings which are corresponding to the first pawl member and the second pawl member.

* * * * *